US010913079B2

(12) United States Patent
Wenzel et al.

(10) Patent No.: US 10,913,079 B2
(45) Date of Patent: Feb. 9, 2021

(54) LOW PRESSURE SPRAY TIP CONFIGURATIONS

(71) Applicant: Wagner Spray Tech Corporation, Plymouth, MN (US)

(72) Inventors: Everett A. Wenzel, Minneapolis, MN (US); Ross D. Rossner, St. Michael, MN (US); Wanjiao Liu, Minneapolis, MN (US)

(73) Assignee: Wagner Spray Tech Corporation, Plymouth, MN (US)

( * ) Notice: Subject to any disclaimer, the term of this patent is extended or adjusted under 35 U.S.C. 154(b) by 0 days.

(21) Appl. No.: 15/132,894

(22) Filed: Apr. 19, 2016

(65) Prior Publication Data

US 2016/0303585 A1 Oct. 20, 2016

Related U.S. Application Data

(60) Provisional application No. 62/149,840, filed on Apr. 20, 2015, provisional application No. 62/203,551, filed on Aug. 11, 2015.

(51) Int. Cl.

| | |
|---|---|
| ***B05B 1/34*** | (2006.01) |
| ***B05B 1/04*** | (2006.01) |
| ***B05B 9/01*** | (2006.01) |

(52) U.S. Cl.

CPC ..... *B05B 1/34* (2013.01); *B05B 1/048* (2013.01); *B05B 9/01* (2013.01)

(58) Field of Classification Search

CPC .... B05B 1/34; B05B 1/02; B05B 1/04; B05B 1/048; B05B 7/00; B05B 7/74;

(Continued)

(56) References Cited

U.S. PATENT DOCUMENTS 3,000,576 A 9/1961 Levey et al.
3,202,360 A * 8/1965 O'Brien ..... B05B 1/042 239/119

(Continued)

FOREIGN PATENT DOCUMENTS

CA 1038622 A 9/1978
CN 1498137 A 5/2004

(Continued)

OTHER PUBLICATIONS

International Search Report and the Written Opinion for PCT/US2016/028285, dated Jul. 18, 2016, Filed Apr. 19, 2016. 11 pages.

(Continued)

*Primary Examiner* — Qingzhang Zhou
*Assistant Examiner* — Christopher R Dandridge
(74) *Attorney, Agent, or Firm* — Wesley W. Malherek; Kelly, Holt & Christenson, PLLC

(57) ABSTRACT

A spray tip configuration for a low pressure fluid sprayer is presented. The spray tip configuration comprises an inlet orifice configured to receive a fluid and to produce a turbulent flow at a known operating point. The spray tip configuration also comprises an outlet orifice configured to emit the fluid in a spray pattern at a turbulence intensity. The spray tip configuration also comprises a passageway fluidically coupling the inlet orifice to the outlet orifice, with a plurality of portions configured to produce the turbulence intensity at the outlet orifice. The passageway comprises a first portion comprising an expansion chamber configured to provide an expanding cross-section from a first portion first end to a first portion second end. The passageway also comprises a second portion comprising a first hydraulic diameter, wherein the second portion is fluidically coupled, on a second portion first end, to the first portion second end. The passageway also comprises a third portion comprising (Continued)

a second hydraulic diameter, wherein the third portion fluidically couples to the second portion at a third portion second end. The passageway also comprises a fourth portion comprising a spray tip, wherein the fourth portion is fluidically coupled, on a fourth portion first end, to a third portion second end, and, on a fourth portion second end, to the outlet orifice.

50 Claims, 23 Drawing Sheets

(58) Field of Classification Search
CPC ..... B05B 7/7438; B05B 1/3405; B05B 1/341; B05B 1/3468; B05B 1/3473; B05B 9/01; B05B 9/03
See application file for complete search history.

(56) References Cited

U.S. PATENT DOCUMENTS

| | | | | |
|---|---|---|---|---|
| 3,556,411 | A | 1/1971 | Nord et al. | |
| 3,633,828 | A | 1/1972 | Larson | |
| 3,858,812 | A | 1/1975 | Williams et al. | |
| 3,865,314 | A | 2/1975 | Levey et al. | |
| 3,955,763 | A | 5/1976 | Pyle et al. | |
| 4,074,857 | A | 2/1978 | Calder | |
| 4,157,163 | A | 6/1979 | Pinto et al. | |
| 4,165,836 | A | 8/1979 | Eull | |
| 4,337,281 | A | 6/1982 | Boone | |
| 4,346,849 | A | 8/1982 | Rood | |
| 4,437,610 | A | 3/1984 | Huber et al. | |
| 4,484,707 | A | 11/1984 | Calder | |
| 4,508,268 | A | 4/1985 | Geberth, Jr. | |
| 4,611,758 | A | 9/1986 | Geberth, Jr. | |
| 4,635,850 | A | 1/1987 | Leisi | |
| 4,721,250 | A | 1/1988 | Kennedy et al. | |
| 4,760,956 | A * | 8/1988 | Mansfield | B29B 7/7438 239/294 |
| 4,815,665 | A | 3/1989 | Haruch | |
| 4,828,182 | A | 5/1989 | Haruch | |
| 5,294,053 | A | 3/1994 | Perret | |
| 5,505,381 | A | 4/1996 | Torntore | |
| 5,749,528 | A | 5/1998 | Carey et al. | |
| 5,765,753 | A | 6/1998 | Kieffer | |
| 5,829,679 | A | 11/1998 | Strong | |
| 5,875,922 | A | 3/1999 | Chastine et al. | |
| 5,887,793 | A | 3/1999 | Kieffer | |
| 5,893,522 | A | 4/1999 | Kieffer | |
| 5,911,364 | A | 6/1999 | Johnson et al. | |
| 6,261,367 | B1 | 7/2001 | Donges | |
| 6,264,115 | B1 | 7/2001 | Liska et al. | |
| 6,352,184 | B1 | 3/2002 | Stern et al. | |
| 6,390,386 | B2 | 5/2002 | Krohn et al. | |
| 6,465,047 | B1 | 10/2002 | Scott et al. | |
| 6,481,640 | B1 | 11/2002 | Carey et al. | |
| 6,502,763 | B1 | 1/2003 | McCann | |
| 6,655,606 | B2 | 12/2003 | Earl | |
| 6,702,198 | B2 | 3/2004 | Tam et al. | |
| 7,328,853 | B2 | 2/2008 | Carey et al. | |
| D651,691 | S | 1/2012 | Muetzel et al. | |
| 8,545,937 | B2 | 10/2013 | Kosovish et al. | |
| 8,596,555 | B2 | 12/2013 | Thompson et al. | |
| 8,814,070 | B2 | 8/2014 | Drozd et al. | |
| 9,010,658 | B2 | 4/2015 | Johnson et al. | |
| 9,016,599 | B2 | 4/2015 | Johnson et al. | |
| 9,085,008 | B2 | 7/2015 | Kinne et al. | |
| 9,192,952 | B2 | 11/2015 | Becker et al. | |
| 2002/0014541 | A1 | 2/2002 | Krohn et al. | |
| 2003/0080213 | A1 | 5/2003 | Clauss et al. | |
| 2003/0189114 | A1 | 10/2003 | Taylor et al. | |
| 2004/0046069 | A1 | 3/2004 | Gromes | |
| 2004/0195354 | A1 | 10/2004 | Leisi | |
| 2007/0129469 | A1 | 6/2007 | Befurt et al. | |
| 2012/0043399 | A1 | 2/2012 | Fortier et al. | |
| 2012/0097765 | A1 | 4/2012 | Drozd et al. | |
| 2012/0205466 | A1 | 8/2012 | Baltz et al. | |
| 2013/0001328 | A1* | 1/2013 | Hsu | B05B 1/3006 239/589 |
| 2013/0037629 | A1 | 2/2013 | Boquet | |
| 2019/0283054 | A1 | 9/2019 | Rossner et al. | |

FOREIGN PATENT DOCUMENTS

| | | | |
|---|---|---|---|
| CN | 1812843 | A | 8/2006 |
| DE | 1218322 | | 6/1966 |
| DE | 2506811 | | 8/1975 |
| DE | 2622396 | B2 | 12/1976 |
| DE | 8032826 | U1 | 7/1981 |
| DE | 3046464 | A1 | 7/1982 |
| DE | 3513587 | A1 | 11/1985 |
| DE | 4401488 | A1 | 7/1995 |
| DE | 19513927 | | 10/1995 |
| EP | 0054124 | A1 | 6/1982 |
| EP | 0112181 | B1 | 6/1984 |
| EP | 0804969 | A2 | 5/1997 |
| EP | 1445030 | A2 | 8/2004 |
| EP | 2136928 | B1 | 12/2009 |
| EP | 2544824 | B1 | 1/2013 |
| GB | 2288348 | A | 10/1995 |
| JP | 05-337405 | A | 12/1993 |
| JP | 2002-522206 | A | 7/2002 |
| JP | 2013-244429 | A | 12/2013 |
| WO | 2005005055 | A1 | 1/2005 |
| WO | 2007092850 | A2 | 8/2007 |
| WO | 2007092850 | A3 | 8/2007 |
| WO | WO 2009147443 | A2 | 12/2009 |
| WO | 2011094246 | A1 | 8/2011 |
| WO | 2015039078 | | 3/2015 |
| WO | 2016128033 | A1 | 8/2016 |
| WO | 2016172105 | | 10/2016 |

OTHER PUBLICATIONS

International Preliminary Report on Patentablility for International Patent Application No. PCT/US2016/028285 dated Oct. 24, 2017, 8 pages.
European Search Report, dated Jan. 31, 2017, 11 pages.
Canadian Office Action, dated Feb. 9, 2018, 6 pages.
Nordson, Airless Nozzle Catalog, Dec. 2003, Pub. Part. No. 107963, Nordson Corporation Liquid Finishing Systems, Amherst, OH, pp. 1-202.
Delavan Spray Technologies, Airless Tips, retrieved at http://www.delavan.co.uk/pdfs/Airless%20Tips.pdf on Nov. 8, 2016, pp. 1-2.
Goodrich, Delavan Spray Technologies, Airless Products, retrieved at http://pdf.directindustry.com/pdf/delavan-spray-technologies/airless-products/13166-102842.html on Nov. 8, 2016, pp. 1-4.
Ecco Finishing , Spare parts for Airless spray tips, retrieved at http://www.eccofinishing.se/API/DownloadFile.ashx?fileID=3537cd88-d0ed-4a58-a209-af71fb29fc79&type=sparepart&lang=en, issued Feb. 2007, pp. 1-2.
Wagner, Wagner GM 4700AC Operating Manual, Jun. 2014, p. 65.
Office Action for Canadian Patent Application No. 2,955,118 dated Nov. 14, 2018. 4 pages.
Examination Report No. 1 for Australian Patent Application No. 2016252285, dated Oct. 13, 2018, 3 pages.
First Office Action for Chinese Patent Application No. 201680002734.0 dated Jul. 2, 2018, 15 pages.
Third Examination Report for Australian Patent Application No. 2016252285 dated May 30, 2019, 2 pages.
Wagner, Aircoat-Wendeschalter Manual, Mar. 1995, pp. 1-2, Germany with Machine Translation.
Second Examlnation Report for Australian Patent Application No. 2016252285 dated Feb. 4, 2019, 6 pages.
Second Office Action for Chinese Patent Application No. 201680002734.0 dated Mar. 4, 2019, 17 pages.
First Examination Report for India Patent Application No. 201627044575 dated Sep. 24, 2019, 8 pages.
Office Action for Canadian Patent Application No. 2,955,118 dated Sep. 25, 2019, 3 pages.

(56) References Cited

OTHER PUBLICATIONS

International Search Report and Written Opinion for International Patent Application No. PCT/US2019/021782, dated Jun. 26, 2019, date of filing: Mar. 12, 2019, 12 pages.
Communication Pursuant to Article 94(3) for European Patent Application No. 16783689.9 dated Dec. 17, 2019, 4 pages.
Third Office Action for Chinese Patent Application No. 201680002734.0 dated Sep. 11, 2019, 10 pages with English Translation.
International Preliminary Report on Patentability for International Patent Application No. PCT/US2019/021782, dated Sep. 24, 2020, date of filing: Mar. 12, 2019, 9 pages.
Restriction Requirement for U.S. Appl. No. 16/297,885 dated Jun. 4, 2020, 9 pages.
Non-Final Office Action for U.S. Appl. No. 16/297,885 dated Jul. 31, 2020, 10 pages.
Response to Restriction Requirement for U.S. Appl. No. 16/297,885 dated Jul. 13, 2020, 2 pages.
Final Office Action for U.S. Appl. No. 16/297,885 dated Nov. 24, 2020, 10 pages.

* cited by examiner

LOW PRESSURE SPRAY TIP CONFIGURATIONS

CROSS-REFERENCE TO RELATED APPLICATIONS

The present application is based on and claims the benefit of U.S. Provisional Patent Application Serial Nos. 62/149,840, filed Apr. 20, 2015, and 62/203,551, filed Aug. 11, 2015, the contents of which are hereby incorporated by reference in their entireties.

BACKGROUND

Spray tips are typically used in a variety of applications to break up, or atomize, a liquid material for delivery in a desired spray pattern. Some exemplary applications include, but are not limited to, applying a coating material such as paint, to a substrate, an agricultural application such as applying a fertilizer, insecticide, or herbicide to plants.

While embodiments described herein are in the context of applying paint to a surface, it is understood that the concepts are not limited to these particular applications. As used herein, paint includes substances composed of coloring matter, or pigments, suspended in a liquid medium as well as substances that are free of coloring matter or pigment. Paint may also include preparatory coatings, such as primers, and can be opaque, transparent, or semi-transparent. Some particular examples include, but are not limited to, latex paint, oil-based paint, stain, lacquers, varnishes, inks, etc.

SUMMARY

A spray tip configuration for a low pressure fluid sprayer is presented. The spray tip configuration comprises an inlet orifice configured to receive a fluid and to produce a turbulent flow at a known operating point. The spray tip configuration also comprises an outlet orifice configured to emit the fluid in a spray pattern at a turbulence intensity. The spray tip configuration also comprises a passageway fluidically coupling the inlet orifice to the outlet orifice, with a plurality of portions configured to produce the turbulence intensity at the outlet orifice. The passageway comprises a first portion comprising an expansion chamber configured to provide an expanding cross-section from a first portion first end to a first portion second end. The passageway also comprises a second portion comprising a first hydraulic diameter, wherein the second portion is fluidically coupled, on a second portion first end, to the first portion second end. The passageway also comprises a third portion comprising a second hydraulic diameter, wherein the third portion fluidically couples to the second portion at a third portion second end. The passageway also comprises a fourth portion comprising a spray tip, wherein the fourth portion is fluidically coupled, on a fourth portion first end, to a third portion second end, and, on a fourth portion second end, to the outlet orifice.

DETAILED DESCRIPTION OF ILLUSTRATIVE EMBODIMENTS

Figure 1A:
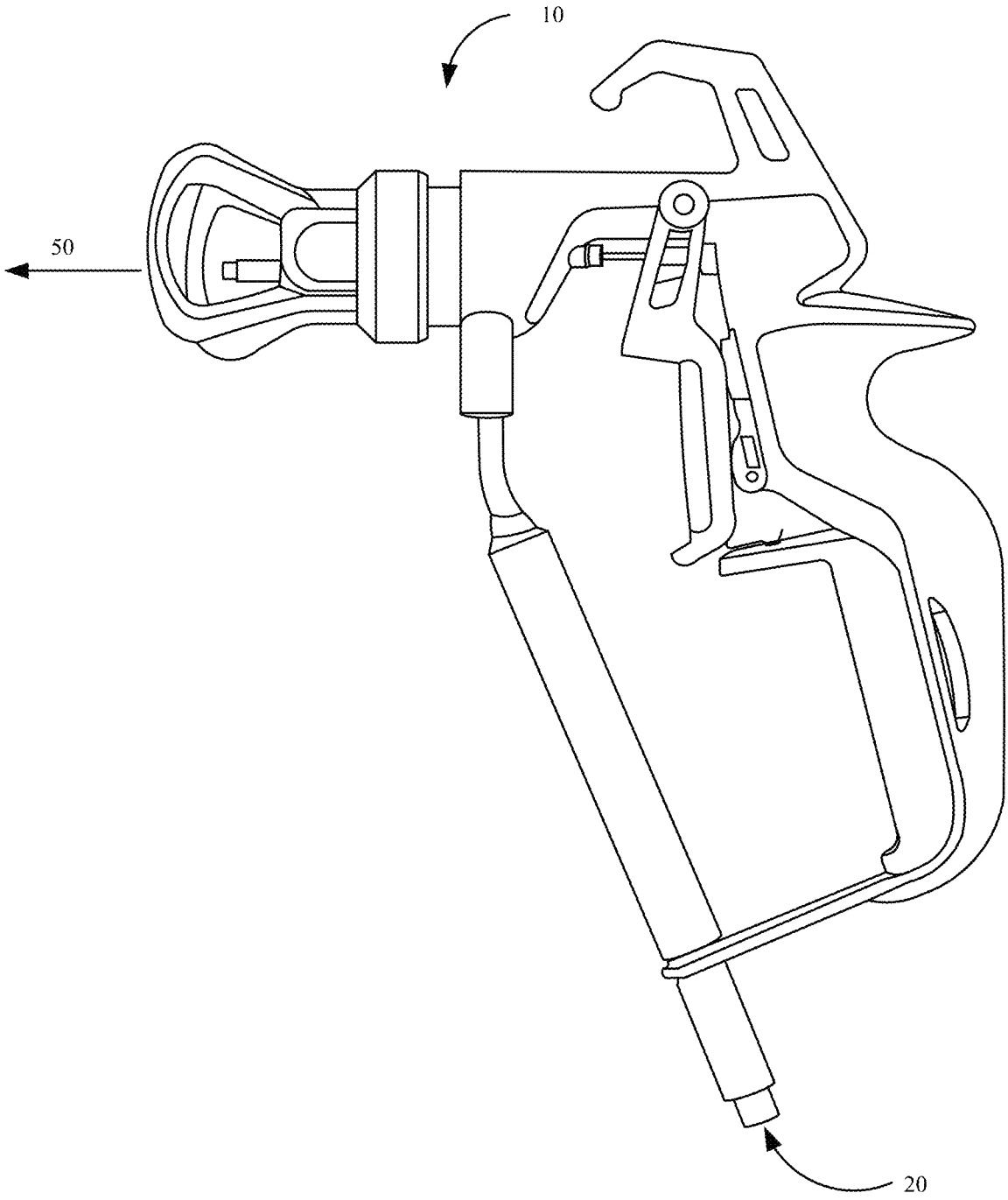
FIGS. 1A-1F illustrate a spray gun and a plurality of spray tip configurations in accordance with one embodiment of the present invention.

In an exemplary fluid spraying system, a pump receives and pressurizes a fluid, delivers the pressurized fluid to an applicator, which applies the pressurized fluid to a desired surface using a spray tip configured with a geometry selected to emit a desired spray pattern (e.g., a round pattern, a flat pattern, or a fan pattern, etc.). The fluid may comprise any fluid applied to surfaces, including, but not limited, for example, paint, primer, lacquers, foams, textured materials, plural components, adhesive components, etc. For the sake of illustration, and not by limitation, the example of a paint spraying system will be described in detail. Paint sprayers function by atomizing a fluid flow prior to dispersal. An average droplet size is desired. If a fluid is atomized into droplets that are too small, overspray occurs. If droplets are too large, an uneven spray occurs. Atomization is achieved by developing instability within a fluid flow. Therefore, it is desired to achieve a desired turbulence intensity at an outlet of the spray gun, such that an even spray is achieved.

In order to apply an even coating, the spray pattern should be substantially uniform, with little or no "tailing effects." Tails, or tailing effects, occur when a higher concentration of the material is delivered along edges, as opposed to a center, of a spray pattern. While existing pre-orifice configurations, and fine finishing tips, have been found to eliminate tails in low pressure applications for some paints, it has been found that these tips usually generate undesired, tapered spray patterns. For surfaces, a uniform spray pattern is desirable for an even and professional looking finish. Furthermore, it may be preferable that the spray pattern has a sharper edge instead of a larger width, because sharper edges can help spraying onto targets when spraying closer to the edges, such as the edges of a wall, for example.

In comparison, traditional high pressure airless spray patterns usually have substantially even coverage and well defined, sharper edges. To reduce tailing effects, conventional airless paint sprayers place the paint under high pressures (typically exceeding 3,000 pounds per square inch (PSI)), which requires the fluid, as well as other components of a liquid spraying system to have a suitable pressure rating. This may increase cost and potential risk to a user. One previous solution was to use an air-assisted spray gun, which comprises introduction of an air source to assist in atomization of fluid at the spray point.

Additionally, one problem associated with using a low pressure spraying system is the variation in viscosity of different paints, or other applied fluids. Paint viscosity differs between uses (e.g., primer, paint, or stain) and can also vary based on differences in manufacturing processes, additives, etc. These differences can result in tailing effects that can vary greatly based on the spray tip geometry and the paint used. A variety of spray tip configurations may allow for a single applicator to consistently apply fluid in a desired pattern, by allowing a user to select a specific tip for a specific application, for example from a spray tip kit comprising of some, or all, of the spray tip configurations disclosed herein.

In order to reduce, or minimize, tailing effects in fluids sprayed at low pressures, at least some embodiments described herein provide improved spray tip geometry, configured for use with fluids with known viscosities. Some embodiments described herein may be preferred for some applications, and not for others, for example based on the viscosity of the fluid to be applied. In at least one embodiment, a plurality of the spray tip configurations described herein are provided as a kit, and intended to be switched out of a spray gun in between different paint spraying jobs.

Embodiments of pre-orifice spray tip configurations are described herein that may achieve substantially uniform spray patterns at pressures lower than those required by typical high-pressure airless spray systems. Low pressure, in one embodiment, may be defined as spray pressure below 3,000 PSI. These embodiments may allow for systems to be designed with lower safety risks and reduced cost, making such systems more readily available for more consumers.

In one embodiment, a pre-orifice configuration for a spray tip is designed to provide a substantially uniform spray pattern, with significantly reduced tailing effects at low operating pressures, at or below 2,000 PSI, for example. FIGS. 1-9 illustrate a plurality of spray tip pre-orifice geometries, each configured to interface with an airless paint spraying device, or other fluid spraying system, to provide a substantially uniform spray pattern with significantly reduced tailing effects at operating pressures at or below approximately 1,000 PSI, in one embodiment. The different geometries described herein offer manufacturers, and users, a plurality of spray tip configurations to choose from, for example, based on a specific paint viscosity for a project. In turn, if sold as a kit, which is envisioned in at least some embodiments, the different geometries offer consumers an optimized experience with different fluids selected for different uses.

One way to eliminate tailing effects in systems operating at low spray pressures (around 1,000 PSI, for example), is to produce turbulence inside the spray nozzle which will accelerate spray sheet breakup. Current well-known, available tips utilize confined entrances to introduce large shearing forces, which may eventually lead to instability and turbulent fluid flow. One example of such a spray tip configuration is shown in U.S. Pat. No. 3,858,812, which describes a low pressure spraying nozzle. While the mechanism describes in U.S. Pat. No. 3,858,812 utilizes a confined entrance to introduce large shear, resulting in a spray pattern that may include a tapered distribution with high flow concentration in the center, and a gradually decreasing concentration away from the center. The pre-orifice disclosed in U.S. Pat. No. 3,858,812 may also introduce mixing effect on spray pattern edges, generating an undesirable fade width.

Spray tip configurations described herein comprise a series of engineered portions with geometric features configured to tune the fluid turbulence intensity. In one embodiment, different portions are manufactured separately, and later assembled to create a desired spray tip configuration. In another embodiment, spray tip configurations are manufactured as a single piece. In one embodiment, spray tip configurations are manufactured as part of an insert for a spray gun assembly. In one embodiment, connecting portions meet at an interface such that fluid flows from one portion to another. At some interfaces, fluid undergoes a rapid expansion or contraction, in embodiments where radii of connecting portions are different. At other interfaces, radii of corresponding portions may be substantially equal, such that expansion or contraction is gradual.

FIGS. 1A-1F illustrate a spray gun and a plurality of spray tip configurations in accordance with one embodiment of the present invention. FIG. 1A illustrates a spray gun 10, for example, configured for use in a paint spraying system. In one embodiment, paint, or another exemplary fluid, enters through spray gun inlet 20, and exits from spray gun outlet 50, after passing through a fluid channel (not shown) within spray gun 10. In one embodiment, a spray tip configuration described herein may be attached to outlet 50 to produce a desired spray pattern. The spray tip pre-orifice configuration may be selected, at least in part, based on known properties of a fluid to be sprayed. In another embodiment, spray tip configurations described herein may be built into spray gun 10, such that outlet 50 comprises a spray tip configuration that increases turbulent fluid flow.

Figure 1C:
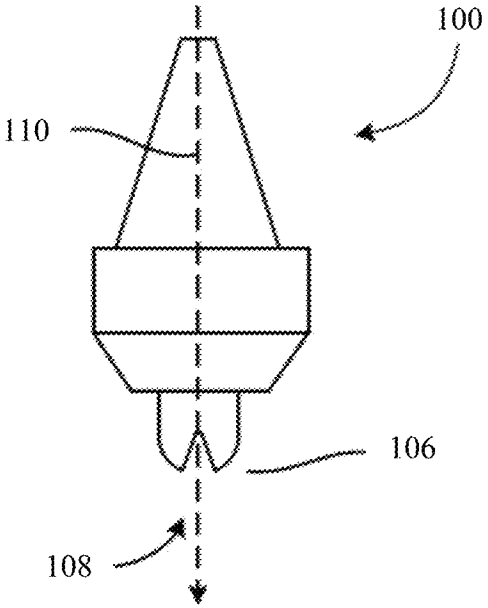
Figure 1B:
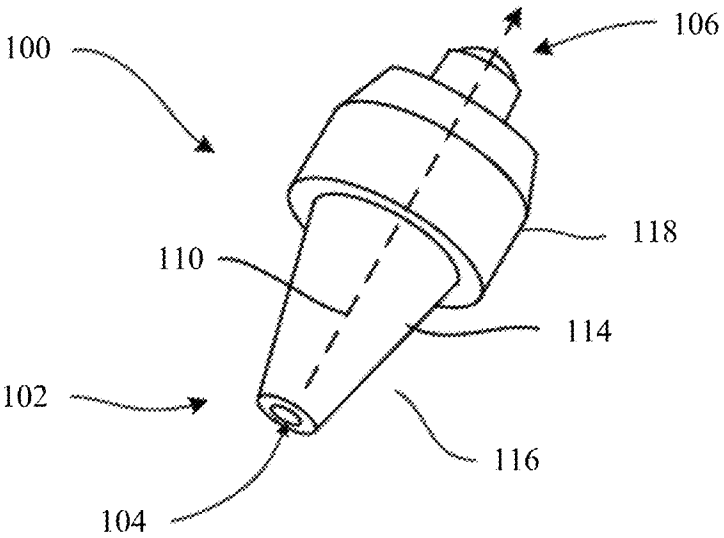
Figure 1D:
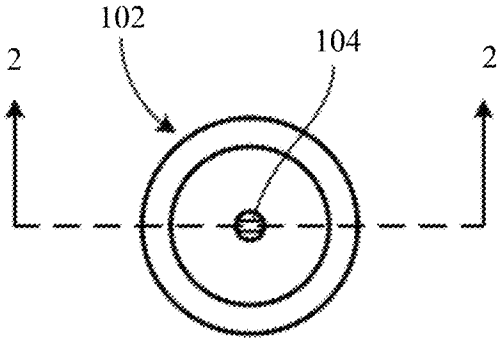

FIGS. 1B, 1C, and 1D illustrate a perspective view, side view, and end view, respectively, of a spray tip configuration 100. In one embodiment, spray tip configuration 100 is part of a kit, provided for use with a spray gun 10, for example, such that a user can attach spray tip configuration 100, for example, to outlet 50 to form a paint spraying system configured to spray paint in a desired spray pattern. In one embodiment, spray tip configuration 100 comprises an inlet end 102 with an inlet orifice 104 configured to receive fluid, and an outlet end 106 with an outlet orifice 108, located downstream from inlet orifice 104, configured to spray the fluid.

The terms "upstream" and "downstream," as used herein, refer to the directions of paint flow through a spray tip configuration, for example spray tip configuration 100, as generally represented in FIGS. 1B and 1C by arrow 110. In one embodiment, outlet orifice 108 has a shape configured to apply fluid in a desired spray pattern. Illustratively, spray tip configuration 100 may comprise an outlet 108 configured to generate either of a fan or flat pattern. In one embodiment, spray tip configuration 100 is configured to generate other appropriate spray patterns.

Spray tip configuration 100, in one embodiment, is formed of any suitable material, including, but not limited to, ceramic and/or carbide materials. Illustratively, a body 114 of spray tip configuration 100 comprises a base portion 116 and an outlet portion 118 that are integral, formed of a single unitary body of substantially uniform material consistency. In another embodiment, portions of body 114 and outlet portion 118 are formed separately and later joined. Portions of body 114 and base 116, in one embodiment, are composed of separate materials.

Figure 1E:
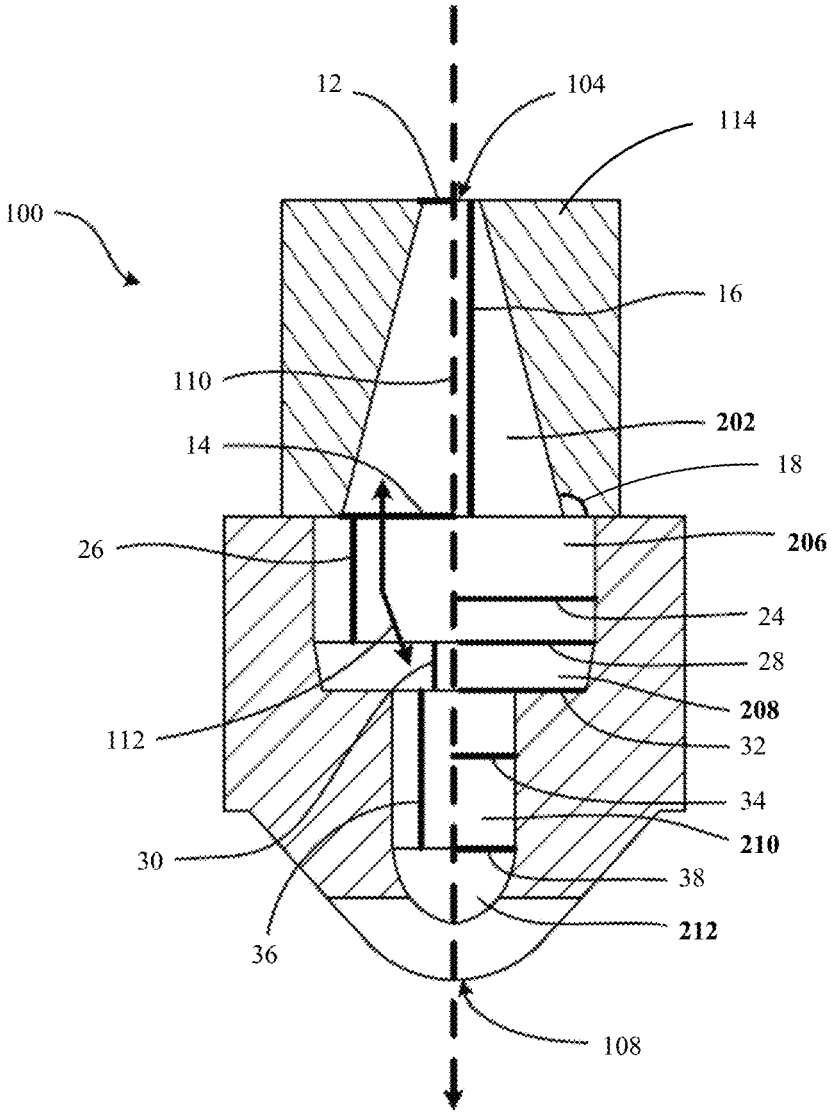
Figure 1F:
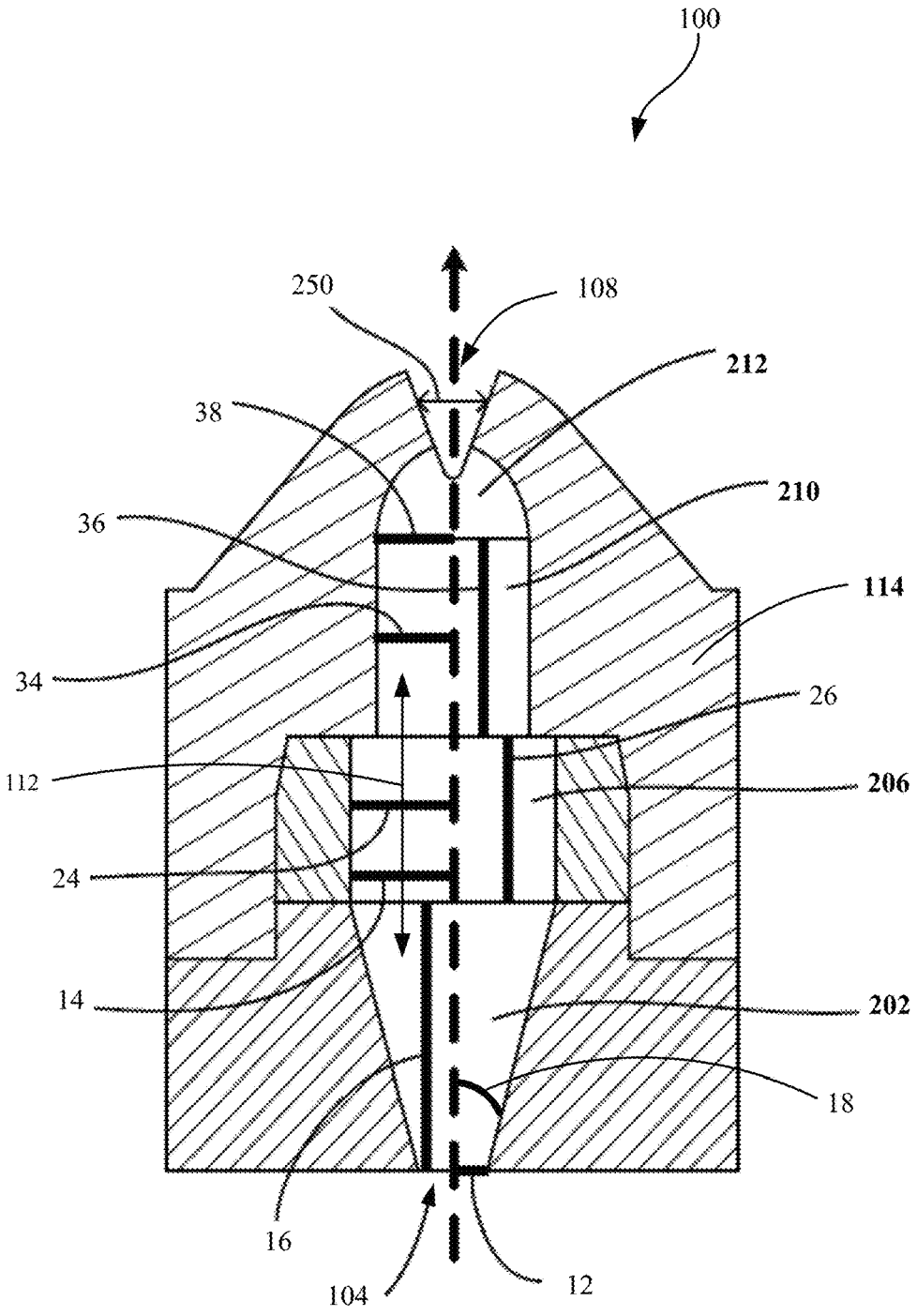

FIGS. 1E-1F illustrate cross-sectional views of a first spray tip configuration 100. FIG. 1E is a cross-sectional view of spray tip configuration 100, taken along line 2-2 shown in FIG. 1D. As shown in FIG. 1E, in one embodiment, a channel 112 is formed through body 114, that fluidically couples inlet orifice 104 to outlet orifice 108. Illustratively, channel 112 is at least partially defined by a plurality of portions: 202, 206, 208, 210 and 212. However, in another embodiment, channel 112 may comprise additional portions, or only a subset of portions: 202, 206, 208, 210 and 212.

Portion 202, in one embodiment, receives fluid flow from an inlet orifice 104, and provides the paint flow through portions 206, 208 and 210, respectively, to portion 212, which provides paint flow to outlet orifice 108.

In accordance with one embodiment, portions 202, 206, 208, 210 and 212 comprise geometries configured to provide turbulence-producing and turbulence-dissipating features configured to tune the turbulence intensity in through channel 112. In one embodiment, turbulence-features may be configured to develop a fully-turbulent flow, and allow for some dissipation of turbulence in the fluid flow prior to a spray point. In one embodiment, turbulence intensity at the outlet is less than 25% of maximum turbulence. In one embodiment, turbulence intensity is less than 20% of maximum turbulence. In one embodiment, turbulence intensity is at least 5% of maximum turbulence. In one embodiment, turbulence intensity is between 5% and 15% of maximum turbulence. Turbulence tuning features may reduce tailing effects experienced by a user, thereby increasing spray pattern uniformity.

In one embodiment, channel 112 is at least partially defined by a portion 202. Portion 202 comprises a truncated cone with a first radius 12, a second radius 14 and an axial distance 16. In one embodiment, radius 12 is the same as a radius of inlet orifice 104. In one embodiment, radius 12 is smaller in than radius 14. In one embodiment, an exterior angle 18 of truncated cone portion 202 is substantially 30°. In another embodiment, exterior angle 18 is slightly greater than 30°. In another embodiment, exterior angle 18 is slightly less than 30°. In another embodiment, channel 112 is configured to provide a net expansion rate, despite any local contractions or other irregularities, for example such as those shown in FIG. 2.

In one embodiment, when thin and/or medium viscosity paint exits an orifice of portion 202, the flow is less than fully turbulent, as at least some of portions 206, 208, and 212 are configured to tune the turbulence intensity to produce a uniform turbulent field with a desired intensity. The desired intensity may be selected in order to break up tails and increase pattern uniformity. When thicker paint exits cone 202, it forms a jet, in one embodiment, that is made unstable by one or more of portions 206, 208 and 2012, which may also be configured to tune the turbulence intensity to produce a uniform turbulent field with the desired intensity to break up tails and increase pattern uniformity In one embodiment, the desired intensity is between 5% and 15% of a fully turbulent flow.

In one embodiment, channel 112 is at least partially defined by a portion 206. Portion 206 comprises a cylinder with a radius 24 and an axial distance 26. In one embodiment, for example, that shown in FIG. 1E, radius 24 is larger than radius 14. However, in another embodiment, radius 24 is substantially equal to radius 14. In one embodiment, radius 14 is smaller than radius 14. FIG. 1E illustrates a cylindrical portion 206. However, in other embodiments, portion 206 comprises other appropriate configurations, for example a square cross-section, or an oval-cross section. In one embodiment, portion 206 is defined by two hydraulic diameters, on a first and second end, connected by a generalized surface. A hydraulic diameter is defined as four times the ratio of the cross-sectional area to the perimeter of a shape. In one embodiment, portion 206 comprises a rectangular prism.

In one embodiment, channel 112 is at least partially defined by a portion 208. Portion 208 comprises a truncated cone with an axial distance 30, a first radius 28, and a second radius 32. In one embodiment, radius 32 is smaller than radius 28. In one embodiment, radius 28 is substantially equal to radius 24. In one embodiment, radius 28 is larger than radius 24. In one embodiment, radius 28 is smaller than radius 24. FIG. 1E illustrates a cone-shaped portion 208. However, other appropriate configurations may be used, in other embodiments, to provide an expansion chamber. For example, a pyramidal structure with a square or rectangle cross-section, or a cone with an ovular cross-section. Portion 208 may also comprise a parabolic-shaped portion. In another embodiment, instead of a smooth surface, portion 208 may comprise a net-expanding cross-section along the distance between radius 28 and radius 32, with local contractions or constant-cross section portions. In one embodiment, a cone-shape provides ease in manufacturing.

In one embodiment, channel 112 is at least partially defined by a portion 210. Portion 210 comprises a cylinder with a radius 34 and an axial distance 36. In one embodiment, radius 34 is equal to radius 32. In one embodiment, radius 34 is larger than radius 32. In one embodiment, radius 34 is substantially smaller than radius 32. In one embodiment, portion 210 comprises a generalized geometry with a hydraulic diameter defined by an effective radius 34. However, in other embodiments, portion 210 comprises other appropriate configurations, for example a square cross-section, or an oval-cross section. In one embodiment, portion 210 is defined by two hydraulic diameters, on a first and second end, connected by a generalized surface.

In one embodiment, channel 112 is at least partially defined by a portion 212. Portion 212 comprises a section of a spheroid, defined by radius 38. In one embodiment, radius 38 is substantially equal to radius 34. In one embodiment, radius 38 is smaller than radius 34. In one embodiment, radius 38 is larger than radius 34. In one embodiment, the spheroid section comprising portion 212 is an oblate spheroid. In another embodiment, the spheroid section comprising portion 212 is a prolate spheroid. In another embodiment, the spheroid section comprising portion 212 is a perfect spheroid. In another embodiment, the spheroid section comprising portion 212 is made imperfect by creases or asymmetries. However, while FIG. 1E illustrates a spherical portion 212, other appropriate geometries may be used in other embodiments. For example, portion 212 may comprise a trapezoidal prism, or a creased spheroid, in another embodiment.

In one embodiment, all of axial distances 16, 26, 30, 36 and radius 38 are substantially equal. In another embodiment, at least some of axial distances 16, 26, 30, 36 and radius 38 are different. In another embodiment, all of axial distances 16, 26, 30, 36 and radius 38 are different.

In one embodiment, a length of the channel 112, comprising the combined lengths of axial distances 16, 26, 30, 36 and radius 38 is at least 0.19 inches. In another embodiment, the length of channel 112 is less than or equal to 0.26 inches. In another embodiment, the length of channel 112 is at least 0.2 inches, 0.21 inches, 0.22 inches, 0.23 inches, 0.24 inches or at least 0.25 inches.

In one embodiment, the radii of any two adjoining portions comprising channel 112 are the same at the interface where they join, for example where portion 202 and 206 intersect, or where portions 206 and 208 intersect, or where portions 208 and 210 intersect, or where portions 210 and 212 intersect. In another embodiment, the radii of two adjoining portions differ at the interface where they join, for example where portions 202 and 206 intersect, or where portions 206 and 208 intersect, or where portions 208 and 210 intersect, or where portions 210 and 212 intersect. In one embodiment, the radii of the adjoining portions comprising channel 112 belong to cylindrical geometries. In another embodiment, the radii of the adjoining portions comprising channel 112 are effective radii of a hydraulic diameter belonging to a generalized cross-sectional area, for example an oval, square, or other appropriate shapes.

FIG. 1F illustrates a cross-sectional view of a spray tip configuration 250, in accordance with one embodiment. Spray tip configuration 250 may, in one embodiment, comprise a subset of the portions of spray tip configuration 100, described above with respect to FIGS. 1A-1E. As shown in FIG. 1F, a channel 112 is formed through body 114, such that it fluidically couples inlet orifice 104 and outlet orifice 108. Illustratively, channel 112 is at least partially defined by a subset, or all of a plurality of portions 202, 206, 210 and 212. However, in another embodiment, channel 112 may include additional portions, or only a subset of the illustrated portions.

Portion 202, in one embodiment, receives paint flow from inlet orifice 104, and is configured to provide the paint flow through portions 206 and 210, respectively, to portion 212, which provides paint flow to outlet orifice 108, in one embodiment.

In accordance with one embodiment, portions 202, 206, 210 and 212 comprise geometries configured to provide turbulence-tuning features configured to produce the desired turbulence profile through channel 112. Turbulence tuning features may reduce tailing effects experienced by a user, thereby increasing spray pattern uniformity. In one embodiment, turbulence-features may be configured to develop a fully-turbulent flow, and allow for some dissipation of turbulence in the fluid flow prior to a spray point. In one embodiment, turbulence intensity at the outlet is less than 25% of maximum turbulence. In one embodiment, turbulence intensity is less than 20% of maximum turbulence. In one embodiment, turbulence intensity is at least 5% of maximum turbulence. In one embodiment, turbulence intensity is between 5% and 15% of maximum turbulence.

In one embodiment, channel 112 is at least partially defined by a portion 202. Portion 202 comprises a cone-shaped portion with a first radius 12, a second radius 14, and an axial distance 16. In one embodiment, first radius 12 is equal to a radius at inlet orifice 104. In one embodiment, radius 12 is smaller than radius 14. However, while FIG. 1F illustrates a cone-shaped portion, other appropriate configurations may be used, in other embodiments, to provide an expansion chamber. For example, a pyramidal structure with a square or rectangle cross-section, or a cone with an ovular cross-section. Portion 202 may also comprise a parabolic-shaped portion. In another embodiment, instead of a smooth surface, portion 202 may comprise a net-expanding cross-section along the distance between radius 12 and radius 14, with local contractions or constant-cross section portions. In one embodiment, a cone-shape provides ease in manufacturing.

In one embodiment, interior angle 18 is 30°. In another embodiment, interior angle 18 is slightly greater than 30°. In another embodiment, interior angle 18 is slightly less than 30°. In one embodiment, the turbulence increasing features functions such that when thin and/or medium viscosity paint exit through an orifice of truncated cone 202 it is a turbulent flow, producing a uniform turbulent field which may break up the tail and increase pattern uniformity. When thicker paint exits the orifice of truncated cone 202, it forms a jet that is made unstable by the downstream geometry of spray tip configuration 100.

In one embodiment, channel 112 is at least partially defined by a portion 206. Portion 206 comprises a cylinder with a radius 24 and axial distance 26. In one embodiment, radius 24 is substantially equal to radius 14. In one embodiment, radius 24 is smaller than radius 14. In one embodiment, radius 24 is larger than radius 14. However, while portion 206 is illustrated as a cylindrical portion, in one embodiment, portion 206 comprises a generalized geometry with a hydraulic diameter defined by an effective radius 24. However, in other embodiments, portion 206 comprises other appropriate configurations, for example a square cross-section, or an oval-cross section. In one embodiment, portion 206 is defined by two hydraulic diameters, on a first and second end, connected by a generalized surface.

In one embodiment, channel 112 is at least partially defined by a portion 210. Portion 210 comprises a cylinder with a radius 34 and axial distance 36. In one embodiment, radius 34 is smaller than radius 24. In one embodiment, radius 34 is substantially equal to radius 24. However, while portion 206 is illustrated as a cylindrical portion, in one embodiment, portion 210 comprises a generalized geometry with a hydraulic diameter defined by an effective radius 34. However, in other embodiments, portion 210 comprises other appropriate configurations, for example a square cross-section, or an oval-cross section. In one embodiment, portion 210 is defined by two hydraulic diameters, on a first and second end, connected by a generalized surface.

In one embodiment, channel 112 is at least partially defined by a portion 212. Portion 212 comprises a section of a spheroid, with radius 38. In one embodiment, radius 38 is substantially equal to radius 34. In one embodiment, radius 38 is smaller than radius 34. In one embodiment, radius 38 is larger than radius 34. In one embodiment, spheroid portion 212 is a section of an oblate spheroid. In another embodiment, spheroid portion 212 is a section of a prolate spheroid. In one embodiment, spheroid portion 212 is a section of a perfect sphere. In another embodiment, the spheroid section comprising portion 212 is made imperfect by creases or asymmetries. However, while FIG. 1F illustrates a spherical portion 212, other appropriate geometries may be used in other embodiments. For example, portion 212 may comprise a trapezoidal prism, or a creased spheroid, in another embodiment.

In one embodiment, all of axial distances 16, 26, 36 and radius 38 are substantially equal. In another embodiment, at least some of axial distances 16, 26, 36 and radius 38 are different. In another embodiment, all of axial distances 16, 26, 36 and radius 38 are different.

In one embodiment, the length of channel 112, comprising the combined lengths of axial distances 16, 26, 36 and radius 38 is at least 0.19 inches. In another embodiment, the length of channel 112 is less than, or equal to, 0.26 inches. In another embodiment, the length of the channel 112 is at least 0.2 inches, 0.21 inches, 0.22 inches, 0.23 inches, 0.24 inches or 0.25 inches.

In one embodiment, the radii of any two adjoining portions are the same at the interface where they adjoin, for example where portions 202 and 206 intersect, or where portions 210 and 212 intersect. In another embodiment, the radii of two adjoining portions differ at the interface where they join, for example where portions 206 and 210 intersect. In one embodiment, the radii of the adjoining portions comprising channel 112 belong to cylindrical geometries. In another embodiment, the radii of the adjoining portions comprising channel 112 are effective radii of a hydraulic diameter belonging to a generalized cross-sectional area, for example an oval, square, or other appropriate shapes.

Figure 2:
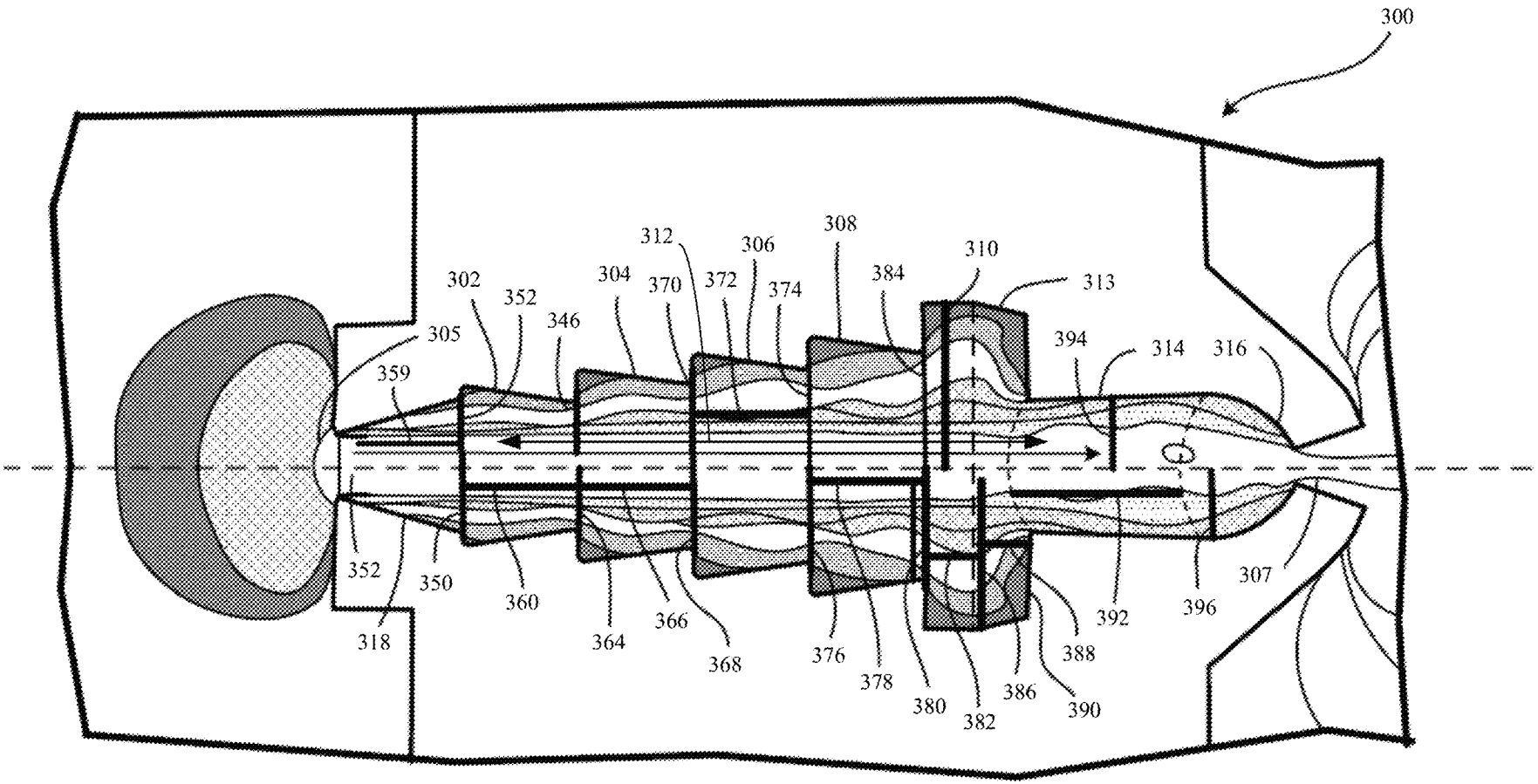
FIG. 2 illustrates a second embodiment of a spray tip configuration in accordance with one embodiment of the present invention.

FIG. 2 illustrates a second embodiment of a spray tip configuration in accordance with one embodiment of the present invention. Spray tip configuration 200, in one embodiment, comprises a fluid channel 312. Fluid channel 312 is formed, in one embodiment, of a plurality of truncated cone portions. In one embodiment, for example as shown in FIG. 2, for at least one portion of channel 312 of spray tip 200, a series of truncated cone portions allow for fluid flow through a series of expanding cross-sectional areas. In one embodiment, as shown in FIG. 2, for at least one portions of channel 312, the first radius is larger than the second radius, such that fluid flows through at least one contracting cross-section.

In one embodiment, cross-sectional area increases as fluid flows through portion 318, and decreases through portions 302, 304, 306, and 308. In one embodiment, the first radii and second radii of portions 302, 304, 306, and 308, respectively, are all different as shown in FIG. 2. In another embodiment, the first radii and second radii of at least some of portions 302, 304, 306, and 308 are similarly sized. In yet another embodiment, the first radii and second radii of at least two of portions 302, 304, 306 and 308 are similarly sized. While five truncated cone portions are illustrated in the example of FIG. 2, additionally, or fewer, truncated cone portions may be present in some embodiments.

In one embodiment, channel 312 is at least partially defined by portions 318, 302, 304, 306, 308, 310, 313, 314, and 316. However, in another embodiment, channel 312 may comprise additional portions or only a subset of portions 318, 302, 304, 306, 308, 310, 313, 314, and/or 316.

Portion 318, in one embodiment, receives paint flow from inlet 305, and provides the paint flow through portions 318, 302, 304, 306, 308, 310, 313, and 314, respectively, to portion 316, which provides paint flow to outlet 307.

In accordance with one embodiment, portions 318, 302, 304, 306, 308, 310, 313, and 314 comprise geometries configured to provide turbulence-tuning capability to provide the desired turbulence intensity profile through channel 312. Turbulence tuning features may reduce tailing effects experienced by a user, thereby increasing spray pattern uniformity.

In one embodiment, channel 312 is at least partially defined by portion 318. Portion 318 comprises a truncated cone with a first radius 352, a second radius 350 and an axial distance 359. In one embodiment, first radius 352 is smaller than second radius 350. In one embodiment, channel 312 comprises inlet orifice 305. In one embodiment, first radius 352 is substantially equal to a radius of inlet orifice 305.

In one embodiment, channel 312 is at least partially defined by a portion 302. Portion 302 comprises a truncated cone portion with an axial distance 360, a first radius 348, and a second radius 346. In one embodiment, radius 346 is smaller than radius 348. In one embodiment, radius 348 is substantially equal to radius 350. In one embodiment, radius 348 is larger than radius 350.

In one embodiment, channel 312 is at least partially defined by a portion 304. Portion 304 comprises a truncated cone with a first radius 364, a second radius 368, and an axial distance 366. In one embodiment, radius 368 is smaller than radius 364. In one embodiment, radius 364 is larger than radius 346. In one embodiment, radius 364 is substantially equal to radius 346.

In one embodiment, channel 312 comprises at least a portion 306. Portion 306 comprises a first radius 370, a second radius 374, and an axial height 372. In one embodiment, radius 374 is smaller than radius 370. In one embodiment, radius 370 is larger than radius 368. In one embodiment, radius 370 is substantially equal to radius 368.

In one embodiment, channel 312 is at least partially defined by portion 308. Portion 308 comprises a truncated cone portion with a first radius 376, a second radius 380, and an axial distance 378. In one embodiment, radius 380 is smaller than radius 376. In one embodiment, radius 376 is larger than radius 374. In one embodiment, radius 376 is substantially equal to radius 374.

In one embodiment, channel 312 is at least partially defined by a portion 310. Portion 310 comprises a cylinder portion with a radius 381 and an axial distance 382. In one embodiment, radius 381 is substantially equal to radius 380. In one embodiment, radius 381 is larger than radius 380.

In one embodiment, channel 312 comprises at least a portion 313. Portion 313 comprises a truncated cone portion defined by a first radius 386, a second radius 390, and an axial height 388. In one embodiment, radius 390 is smaller than radius 386. In one embodiment, radius 386 is substantially equal to radius 381. In one embodiment, radius 386 is larger than radius 381. In one embodiment, radius 386 is smaller than radius 381.

In one embodiment, channel 312 is at least partially defined by a portion 314. Portion 314 comprises a cylinder defined by an axial height 392 and a radius 394. In one embodiment, radius 394 is substantially smaller than radius 386.

In one embodiment, channel 312 is at least partially defined by a portion 316. Portion 316 comprises a section of a spheroid with radius 396. In one embodiment, radius 316 is substantially equal to radius 394. In one embodiment, radius 316 is smaller than radius 394. In one embodiment, radius 316 is larger than radius 394. In one embodiment, the spheroid section comprising portion 316 is an oblate spheroid. In another embodiment, the spheroid section comprising portion 316 is a prolate spheroid. In another embodiment, the spheroid section comprising portion 316 is a perfect sphere.

In one embodiment, axial distances 359, 360, 366, 372 and 378 are substantially equal, and larger than axial distances 382 and 388. In another embodiment, at least some of axial distances 359, 360, 366, 372 and 378 are different.

In at least one embodiment, some low pressure spray tip configurations presented herein achieve a turbulent flow field with a desired turbulence intensity without local high mass flux at its center. In one embodiment, spray tip configurations comprise a turbulent decaying zone downstream from a point of maximum turbulent flow, configured to produce a uniform turbulence across the spray pattern, thereby breaking up any produced tails, and producing a uniform pattern with a sharp edge. In one embodiment, turbulence-features may be configured to develop a fully-turbulent flow, and allow for some dissipation of turbulence in the fluid flow prior to a spray point. In one embodiment, turbulence intensity at the outlet is less than 25% of maximum turbulence. In one embodiment, turbulence intensity is less than 20% of maximum turbulence. In one embodiment, turbulence intensity is at least 5% of maximum turbulence. In one embodiment, turbulence intensity is between 5% and 15% of maximum turbulence. Therefore, the spray pattern produced by at least some of the spray tip configurations disclosed herein, may have, in one embodiment, the same coverage across the fan width, with relatively sharp edges and no tailings effects.

Figure 3A:
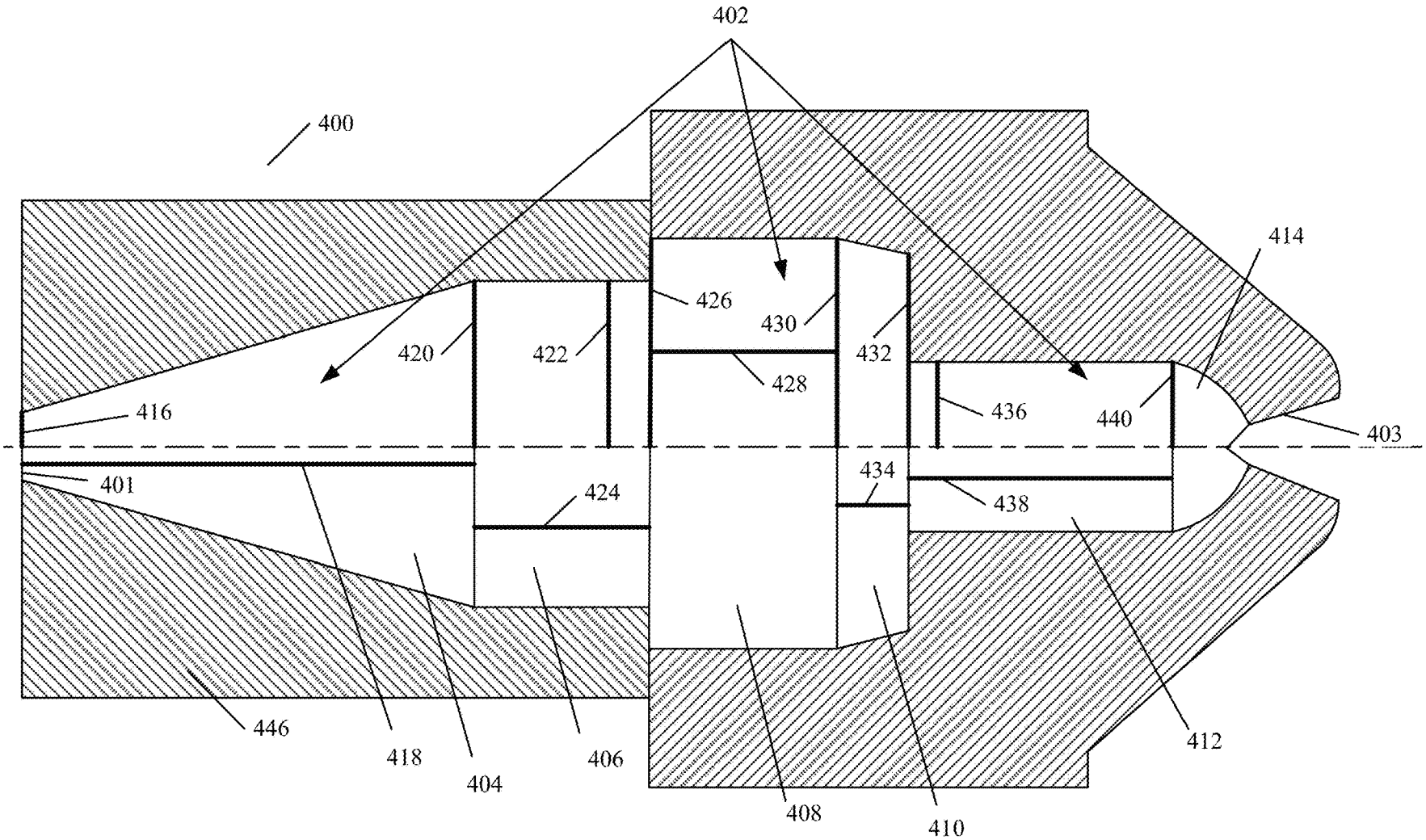
FIGS. 3A-3B illustrate a third embodiment of a spray tip configuration and transitional jet velocity contour patterns in accordance with embodiments of the present invention.
Figure 3B:
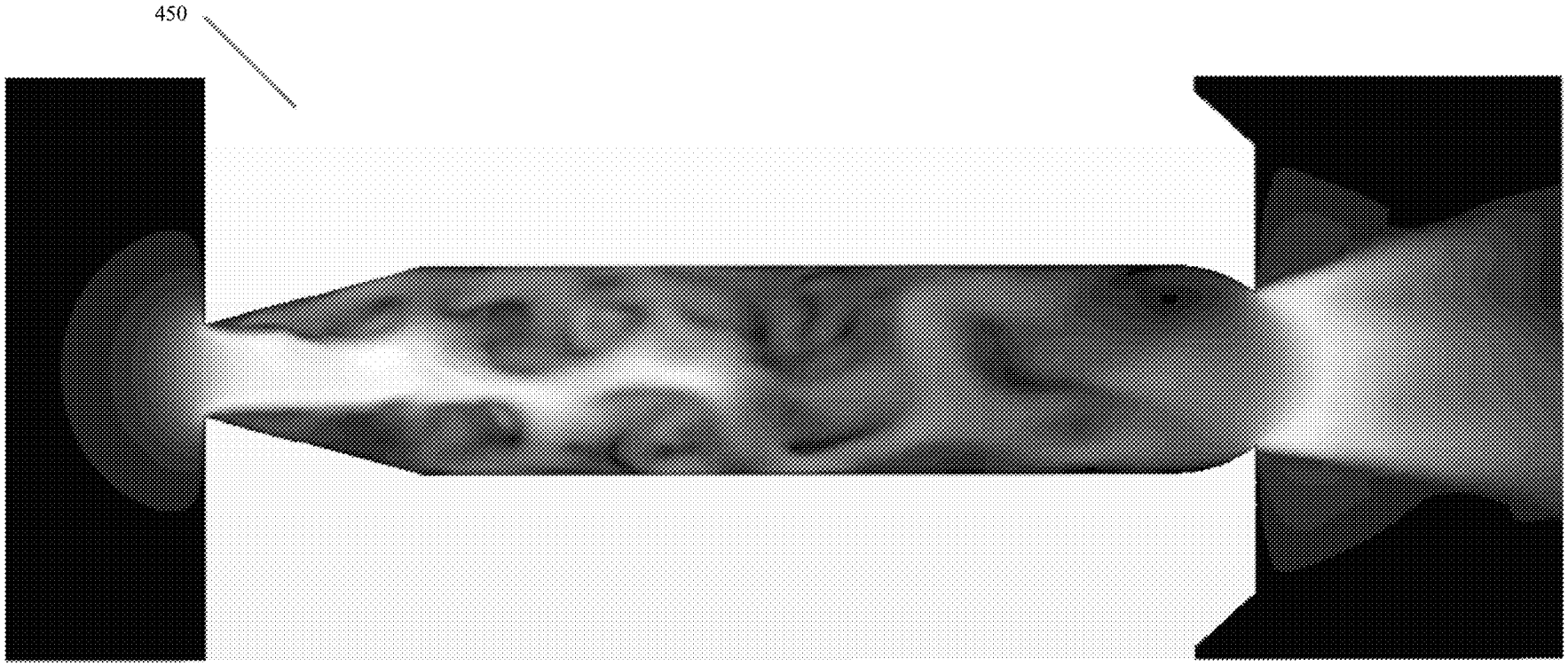

FIGS. 3A-3B illustrate a third embodiment of a spray tip configuration and transitional jet velocity contour patterns in accordance with embodiments of the present invention. FIG. 3A illustrates a cross-sectional view of an exemplary pre-orifice spray tip configuration 400 with a U-cut outlet orifice. However, in another embodiment, spray tip configuration 400 could be configured with a V-cut outlet orifice, for example as shown in FIG. 1E. As shown in FIG. 3A, in one embodiment, a channel 402 is formed through a body 446 of spray tip configuration 400. Channel 402, in one embodiment, is fluidically coupled to an inlet 401, on a first end, and to an outlet 403, on a second end. Illustratively, channel 402 is at least partially defined by portions 404, 406, 408, 410, 412 and 414, in one embodiment. However, in another embodiment, channel 402 may comprise additional portions, or only a subset of portions 404, 406, 408, 410, 412 and 414.

In one embodiment, channel 402 is at least partially defined by portion 404. Portion 404 comprises a truncated cone defined by a first radius 416, a second radius 420, and an axial distance 418. Radius 416, in one embodiment, is smaller than radius 420. Cone portion 404, in one embodiment, is fluidically coupled, on a first end, to inlet 401, and is fluidically coupled, on a second end, to cylinder portion 406. In one embodiment, radius 416 is substantially equal to a radius of inlet 401. FIG. 3A illustrates a cone-shaped portion 404. However, other appropriate configurations may be used, in other embodiments, to provide an expansion chamber. For example, a pyramidal structure with a square or rectangle cross-section, or a cone with an ovular cross-section. Portion 404 may also comprise a parabolic-shaped portion. In another embodiment, instead of a smooth surface, portion 404 may comprise a net-expanding cross-section along the distance between radius 416 and radius 420, with local contractions or constant-cross section portions. In one embodiment, a cone-shape provides ease in manufacturing In one embodiment, channel 402 is at least partially defined by portion 406. Portion 406 comprises a cylinder defined by a radius 422, and an axial distance 424. In one embodiment, radius 422 is substantially equal to radius 420. In another embodiment, radius 422 is larger than radius 420. In another embodiment, radius 422 is smaller than radius 420. Cylindrical portion 406 is, in one embodiment, fluidically coupled, on a first end, to cone portion 404, and fluidically coupled, on a second end, to cylinder portion 408. In one embodiment, portion 402 comprises a generalized geometry with a hydraulic diameter defined by an effective radius 422. However, in other embodiments, portion 402 comprises other appropriate configurations, for example a square cross-section, or an oval-cross section. In one embodiment, portion 210 is defined by two hydraulic diameters, on a first and second end, connected by a generalized surface.

In one embodiment, channel 402 is at least partially defined by cylinder portion 408. Portion 408 comprises a cylinder defined by an axial distance 428 and a radius 426. In one embodiment, radius 426 is larger than radius 422. In another embodiment, radius 426 is substantially equal to radius 422. Cylinder portion 428 is, in one embodiment, fluidically coupled on a first end to cylinder portion 306, and fluidically coupled on a second end to portion 410. In one embodiment, portion 410 comprises a generalized geometry with a hydraulic diameter defined by an effective radius 426. However, in other embodiments, portion 410 comprises other appropriate configurations, for example a square cross-section, or an oval-cross section. In one embodiment, portion 410 is defined by two hydraulic diameters, on a first and second end, connected by a generalized surface.

In one embodiment, channel 402 is at least partially defined by portion 410. Portion 410 comprises a truncated cone portion with a first radius 430, a second radius 432, and an axial distance 434. In one embodiment, radius 430 is substantially equal to radius 426. In another embodiment, radius 430 is larger than radius 426. In another embodiment, radius 430 is smaller than radius 426. In one embodiment, radius 432 is smaller than radius 430. Portion 410, in one embodiment, is fluidically coupled on a first end to cylinder portion 408, and is fluidically coupled on a second end to cylinder portion 412. However, while FIG. 3A illustrates a con-shaped portion 410, other appropriate configurations may be used, in other embodiments, to provide a convergent cross-section. For example, a pyramidal structure with a square or rectangle cross-section, or a cone with an ovular cross-section. Portion 410 may also comprise a parabolic-shaped portion. In another embodiment, instead of a smooth surface, portion 410 may comprise a net-contracting cross-section along the distance between radius 430 and radius 432, with local contractions or constant-cross section portions. In one embodiment, a cone-shape provides ease in manufacturing.

In one embodiment, channel 402 is at least partially defined by portion 412. In one embodiment, portion 412 comprises a cylinder defined by an axial distance 438 and a radius 436. In one embodiment, radius 436 is substantially smaller than radius 432. In another embodiment, radius 436 is substantially equal to radius 432. Cylinder portion 412 is, in one embodiment, fluidically coupled on a first end, to cylinder portion 410, and fluidically coupled on a second end to a spheroid portion 414. In one embodiment, portion 412 comprises a generalized geometry with a hydraulic diameter defined by an effective radius 436. However, in other embodiments, portion 412 comprises other appropriate configurations, for example a square cross-section, or an oval-cross section. In one embodiment, portion 412 is defined by two hydraulic diameters, on a first and second end, connected by a generalized surface.

In one embodiment, channel 402 is at least partially defined by portion 414. Portion 414 comprises a section of a spheroid defined by a radius 440. In one embodiment, radius 440 is substantially equal to radius 436. In one embodiment, radius 440 is larger than radius 446. In one embodiment, radius 440 is smaller than radius 446. Portion 414 is, in one embodiment, fluidically coupled, on a first end, to cylinder portion 412, and is fluidically coupled, on a second end, to outlet 403. In one embodiment, portion 414 comprises a section of an oblate spheroid. In another embodiment, portion 414 comprises a section of a prolate spheroid. In another embodiment, portion 414 comprises a section of a perfect sphere. In another embodiment, the spheroid section comprising portion 414 is made imperfect by creases or asymmetries. However, while FIG. 3A illustrates a spherical portion 414, other appropriate geometries may be used in other embodiments. For example, portion 414 may comprise a trapezoidal prism, or a creased spheroid, in another embodiment.

In one embodiment, all of axial distances 418, 424, 428, 434, 438 and radius 440 are substantially equal. In another embodiment, at least some of axial distances 418, 424, 428, 434, 438 and radius 440 are different. In another embodiment, all of axial distances 418, 424, 428, 434, 438 and radius 440 are different.

FIG. 3B illustrates an exemplary transitional jet velocity curve 450, which may be produced, in one embodiment, using an embodiment of spray tip configuration 400, coupled to a spray gun, for example spray gun 10, at low pressures.

In one embodiment, the radii of the adjoining portions comprising channel 402 belong to cylindrical geometries. In another embodiment, the radii of the adjoining portions comprising channel 402 are effective radii of a hydraulic diameter belonging to a generalized cross-sectional area, for example an oval, square, or other appropriate shapes.

Figure 3C:
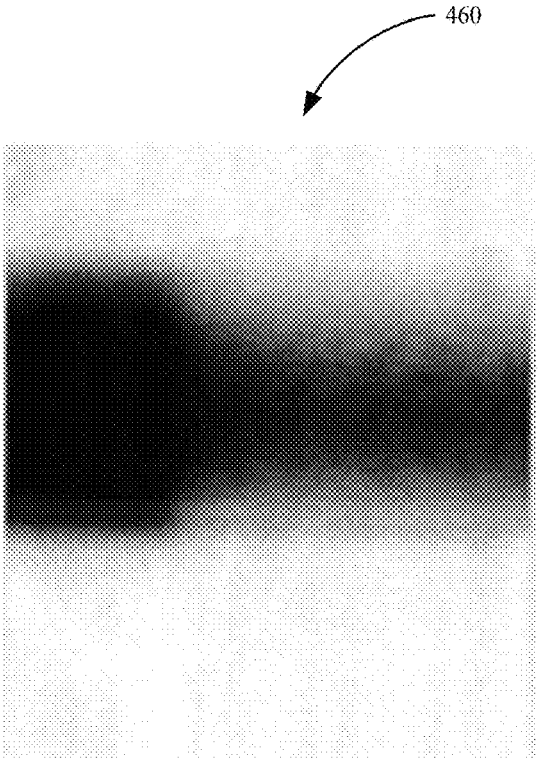
FIGS. 3C-3E illustrate comparative spray patterns in accordance with an embodiment of the present invention.
Figure 3D:
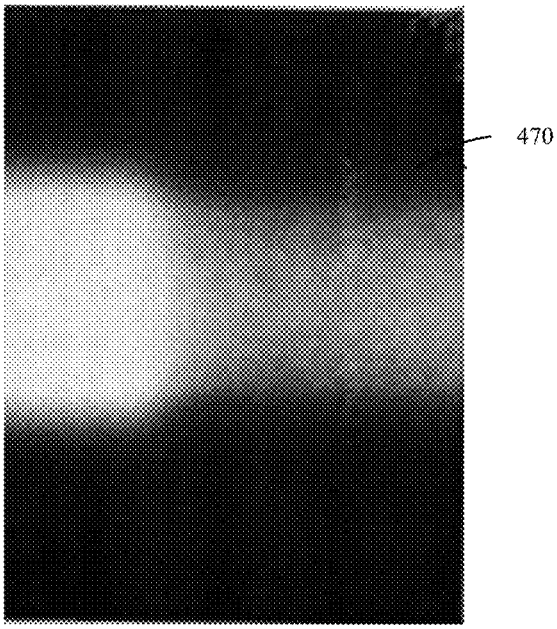
Figure 3E:
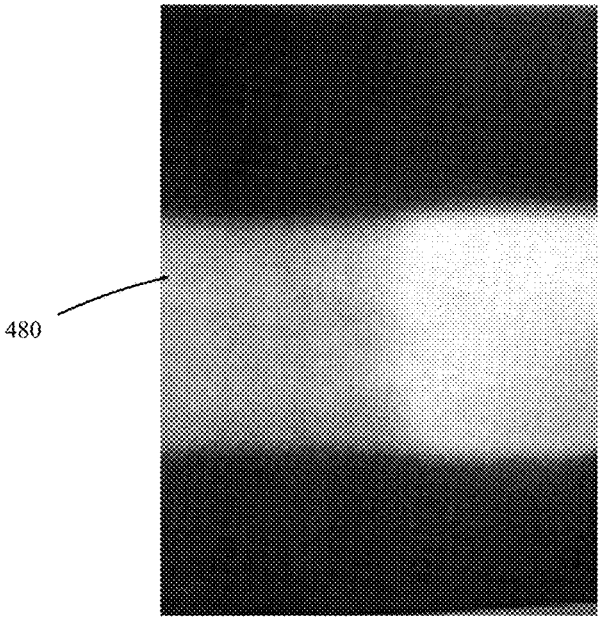

FIGS. 3C-3E illustrate comparative spray patterns in accordance with an embodiment of the present invention. FIGS. 3C and 3D illustrate exemplary tapered spray patterns that might be achieved using pre-orifice designs previously known in the industry. The tapered distribution shown in FIGS. 3C and 3D may, for example, be produced using a spray nozzle with the mechanism described in U.S. Pat. No. 3,858,812, for example. FIG. 3C is a perspective view of a tapered distribution spray pattern 460 generated by a pre-orifice mechanism at 1,000 PSI, as experienced using a prior art spray tip configuration. FIG. 3D is a perspective view of a large fade width spray pattern 470 generated by, for example using the prior art pre-orifice described in U.S. Pat. No. 3,858,812 at 1,000 PSI, for example.

FIG. 3E illustrates a perspective view of an exemplary uniform spray pattern 480 with a sharp edge generated by using spray tip configuration 400, at 1,000 PSI, in one embodiment. The sharp edges of spray pattern 480, shown in FIG. 3E, indicate a uniform spray pattern with little to no tailing effect. Such a spray pattern producing a more professional looking finish, especially when compared to the spray patterns illustrated in FIGS. 3C and 3D.

Figure 4A:
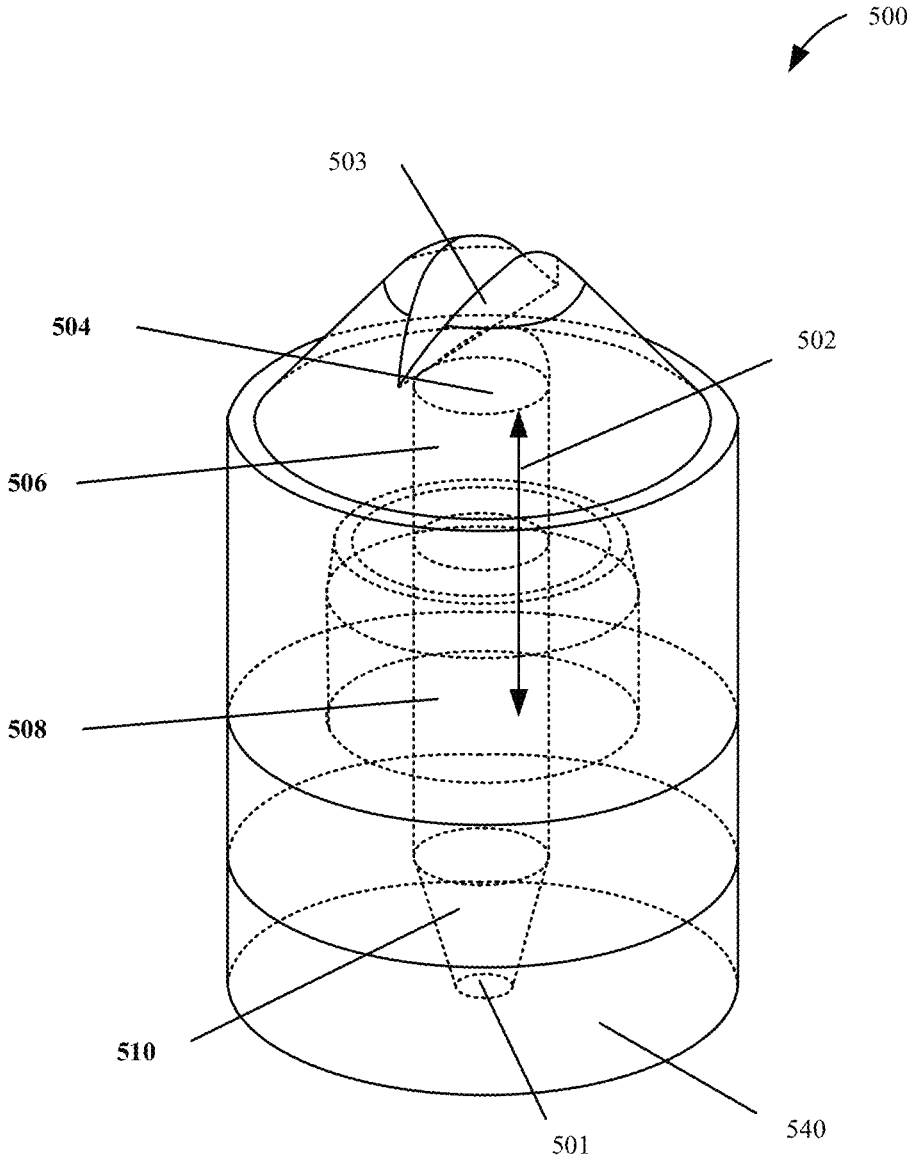
FIGS. 4A-4B illustrate a fourth alternative embodiment of a spray tip configuration in accordance with one embodiment of the present invention.
Figure 4B:
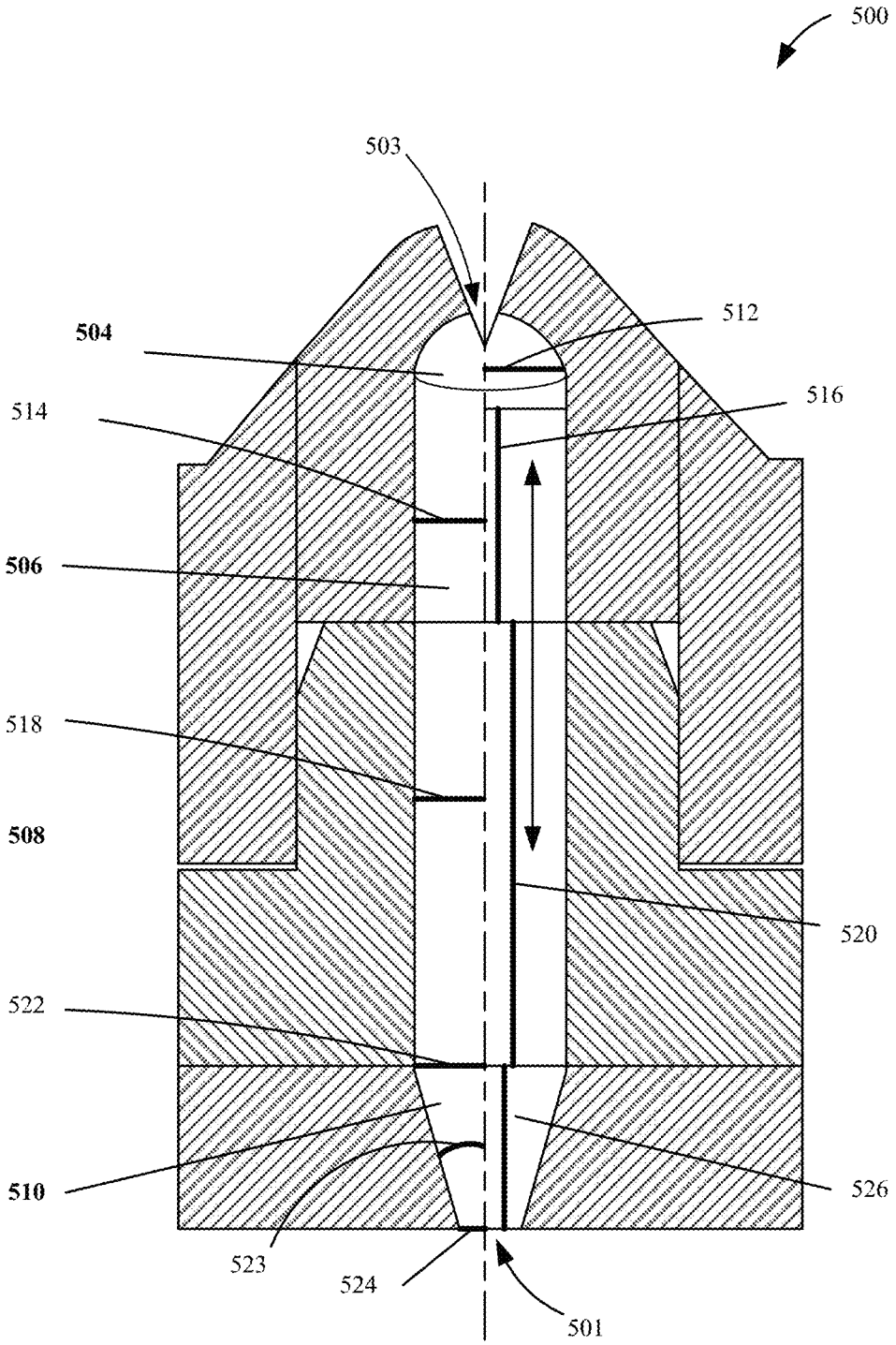

FIGS. 4A-4B illustrate a fourth alternative embodiment of a spray tip configuration in accordance with one embodiment of the present invention. FIG. 4A is an illustration of a pre-orifice spray tip configuration 500 enclosed within body 540. As shown in FIG. 4A, a channel 502 extends through spray tip configuration 500, and fluidically couples portion 504, 506, 508 and 510, between an inlet 501 and an outlet 503. In one embodiment, channel 502 extends through a subset of, or all of, a plurality of portions 504, 506, 508 and 510, proceeding from an inlet 501 to an outlet 503. However, in another embodiment, channel 502 may include additional portions, or only a subset of illustrated portions 504, 506, 508 and 510.

In accordance with one embodiment, portions 504, 506, 508 and 510 comprise geometric features configured to provide turbulence-tuning capability configured to produce a desired-turbulence profile through channel 502. Turbulence tuning features may reduce tailing effects experienced by a user, thereby increasing spray pattern uniformity. In one embodiment, turbulence-features may be configured to develop a fully-turbulent flow, and allow for some dissipation of turbulence in the fluid flow prior to a spray point. In one embodiment, turbulence intensity at the outlet is less than 25% of maximum turbulence. In one embodiment, turbulence intensity is less than 20% of maximum turbulence. In one embodiment, turbulence intensity is at least 5% of maximum turbulence. In one embodiment, turbulence intensity is between 5% and 15% of maximum turbulence.

FIG. 4B illustrates a cross-sectional view of a pre-orifice spray tip configuration 500. In accordance with one embodiment, portions 502, 504, 506, 508 and 510 provide features along channel 502 designed to produce a desired turbulence intensity at outlet 503. The turbulence tuning features, in combination, may eliminate non-uniform mass flux, and high mass flux near the center line. Furthermore, these turbulence tuning features may reduce tailing and mixing effects, thereby increasing spray pattern uniformity.

In one embodiment, channel 502 is at least partially defined by a portion 510. Portion 510 comprises a truncated cone defined by a first radius 524, a second radius 522, and an axial distance 526. In one embodiment, portion 510 is fluidically coupled, on a first end, to inlet 501, and, on a second end, to portion 508. In one embodiment, first radius 524 is substantially the same as a radius of the inlet 501. In one embodiment, radius 524 is smaller than radius 522. In one embodiment, interior angle 523 is 30°. In another embodiment, interior angle 523 is slighter greater than 30°. In another embodiment, interior angle 523 is slightly less than 30°. In one embodiment, the turbulence increasing features functions such that the sharp edge at inlet 501 creates a large shear rate to introduce the strongest disturbances to the flow. FIG. 4B illustrates a cone-shaped portion 510. However, other appropriate configurations may be used, in other embodiments, to provide an expansion chamber. For example, a pyramidal structure with a square or rectangle cross-section, or a cone with an ovular cross-section. Portion 510 may also comprise a parabolic-shaped portion. In another embodiment, instead of a smooth surface, portion 510 may comprise a net-expanding cross-section along the distance between radius 524 and radius 522, with local contractions or constant-cross section portions. In one embodiment, a cone-shape provides ease in manufacturing.

In one embodiment, channel 502 is at least partially defined by a portion 508. Portion 508 comprises a cylinder defined by a radius 518 and an axial distance 520. In one embodiment, radius 518 is substantially equal to radius 522. In another embodiment, radius 518 is larger than radius 522. In another embodiment, radius 518 is smaller than radius 522. In one embodiment, cylinder portion 508 is fluidically coupled, on one end, to portion 510, and fluidically coupled, on a second end, to portion 506. FIG. 4B illustrates a cylindrical-shaped portion. However, other appropriate configurations may be used. For example, in one embodiment, portion 508 comprises a generalized geometry with a hydraulic diameter defined by an effective radius 518. However, in other embodiments, portion 508 comprises other appropriate configurations, for example a square cross-section, or an oval-cross section. In one embodiment, portion 508 is defined by two hydraulic diameters, on a first and second end, connected by a generalized surface.

In one embodiment, channel 502 is at least partially defined by a portion 506. Portion 506 comprises a cylinder defined by an axial distance 516 and a radius 514. In one embodiment, radius 514 is substantially equal to radius 518. In another embodiment, radius 516 is larger than radius 518. In another embodiment, radius 514 is smaller than radius 518. Cylinder portion 506 is, in one embodiment, fluidically coupled, on a first end, to portion 508, and fluidically coupled, on a second end, to portion 504. FIG. 4B illustrates a cylindrical-shaped portion. However, other appropriate configurations may be used. For example, in one embodiment, portion 506 comprises a generalized geometry with a hydraulic diameter defined by an effective radius 514. However, in other embodiments, portion 506 comprises other appropriate configurations, for example a square cross-section, or an oval-cross section. In one embodiment, portion 506 is defined by two hydraulic diameters, on a first and second end, connected by a generalized surface.

In one embodiment, channel 502 is at least partially defined by a portion 504. Portion 504 comprises a section of a spheroid defined by a radius 512. In one embodiment, portion 504 is a section of an oblate spheroid. In another embodiment, portion 504 is a section of a prolate spheroid. In another embodiment, portion 504 is a section of a perfect sphere. In one embodiment, radius 512 is substantially equal to radius 514. In another embodiment, radius 512 is larger than radius 514. In another embodiment, radius 512 is smaller than radius 514. In one embodiment, portion 504 is fluidically coupled, on a first end, to portion 506, and fluidically coupled, on a second end, to outlet 503. In one embodiment, portion 504 includes outlet 503. In another embodiment, the spheroid section comprising portion 504 is made imperfect by creases or asymmetries. However, while FIG. 4B illustrates a spherical portion 504, other appropriate geometries may be used in other embodiments. For example, portion 504 may comprise a trapezoidal prism, or a creased spheroid, in another embodiment.

In one embodiment, all of axial distances 526, 520, 516 and radius 512 are substantially equal. In another embodiment, at least some of axial distances 526, 520, 516 and radius 512 are different. In one embodiment, axial distance 520 is substantially larger than axial distance 516. In one embodiment, the radii of the adjoining portions comprising channel 502 belong to cylindrical geometries. In another embodiment, the radii of the adjoining portions comprising channel 502 are effective radii of a hydraulic diameter belonging to a generalized cross-sectional area, for example an oval, square, or other appropriate shapes In accordance with one embodiment, the portions forming channel 502 comprise a confined entrance at inlet 501, defined by a sharp edge, followed by truncated cone portion 510 forming, for example, an expansion channel. Channel 502 continues, in one embodiment, providing a straight tunnel through cylindrical portions 508 and 506, leading to spheroid portion 504, before providing an exit for fluid flow through outlet 503. In one embodiment the expansion channel through portion 508 and/or 506 is configured to produce an inverse pressure gradient, causing destabilization within channel 502. Under such a combination, or similar combination of portions, channel 502 becomes fully turbulent downstream of inlet 501. Therefore, in one embodiment, channel 502, formed of a combination of portions 504, 506, 508 and 510 along with inlet 501 and outlet 503, introduce turbulence-increasing and turbulence-decreasing features designed to break up tailing effects without creating concentrated mass flux at the center of the spray pattern.

Pre-orifice spray tip configuration 500, along with outer shell 540, may be formed of any suitable material, including, but not limited to, ceramic and carbide materials. Illustratively, configuration 500 comprises portions 504, 506, 508, 510 and outer shell 540 that are integral, formed of a single unitary body. In another embodiment, portions 504, 506, 508, 510 and outer shell 540 are formed separately. In one embodiment, portions 504, 506, 508, 510 and outer shell 540 are formed of different materials. In another example, the portions are mechanically formed as separate segments and combined at a later time.

Pre-orifice spray tip configuration 500 may, in one embodiment, be configured such that first radius 524 at pre-orifice inlet 501 satisfies certain criteria determined by Reynolds number calculations. The Reynolds number Re, characterizes the ratio of inertia forces to viscous forces and is given by Equation 1 below:

$$Re = \frac{\rho U D}{\mu} \qquad \text{Equation 1}$$

In Equation 1, ρ is density of the fluid, D is the hydraulic diameter of pre-orifice inlet 401, and μ is the viscosity of the fluid at pre-orifice inlet 501. U is the characteristic velocity of the fluid, and is given by Equation 2, below:

$$U = \frac{Q}{\frac{1}{4}\pi D^2} \qquad \text{Equation 2}$$

In Equation 2, Q comprises the volumetric flow rate.

In one embodiment, the Reynolds number criterion is given by Equation 3 below:

$$Re > Re_{crit} \qquad \text{Equation 3}$$

In Equation 3, the $Re_{crit}$ is the critical Reynolds number.

In one embodiment, the criteria for the diameter of pre-orifice inlet 501 of pre-orifice spray tip configuration 500 is given by Equation 4 below:

$$D < D_{crit} = \frac{\rho Q}{\frac{1}{4}\pi \mu Re_{crit}} \qquad \text{Equation 4}$$

In one embodiment, the diameter D of a pre-orifice inlet 501 is smaller than the critical value, $D_{crit}$. However, decreasing the diameter of pre-orifice inlet 501 may, in one embodiment, result in a large pressure drop that is not desirable.

In one embodiment, determining $Re_{crit}$ and $D_{crit}$ allows for designing of portions comprising a spray tip configuration such that a desired turbulence intensity is achieved. In one embodiment, turbulence-features may be configured to develop a fully-turbulent flow, and allow for some dissipation of turbulence in the fluid flow prior to a spray point, as shown in FIG. 5B for example, between peak turbulence achieved and an outlet. In one embodiment, turbulence intensity at the outlet is less than 25% of maximum turbulence. In one embodiment, turbulence intensity is less than 20% of maximum turbulence. In one embodiment, turbulence intensity is at least 5% of maximum turbulence. In one embodiment, turbulence intensity is between 5% and 15% of maximum turbulence.

Figure 5A:
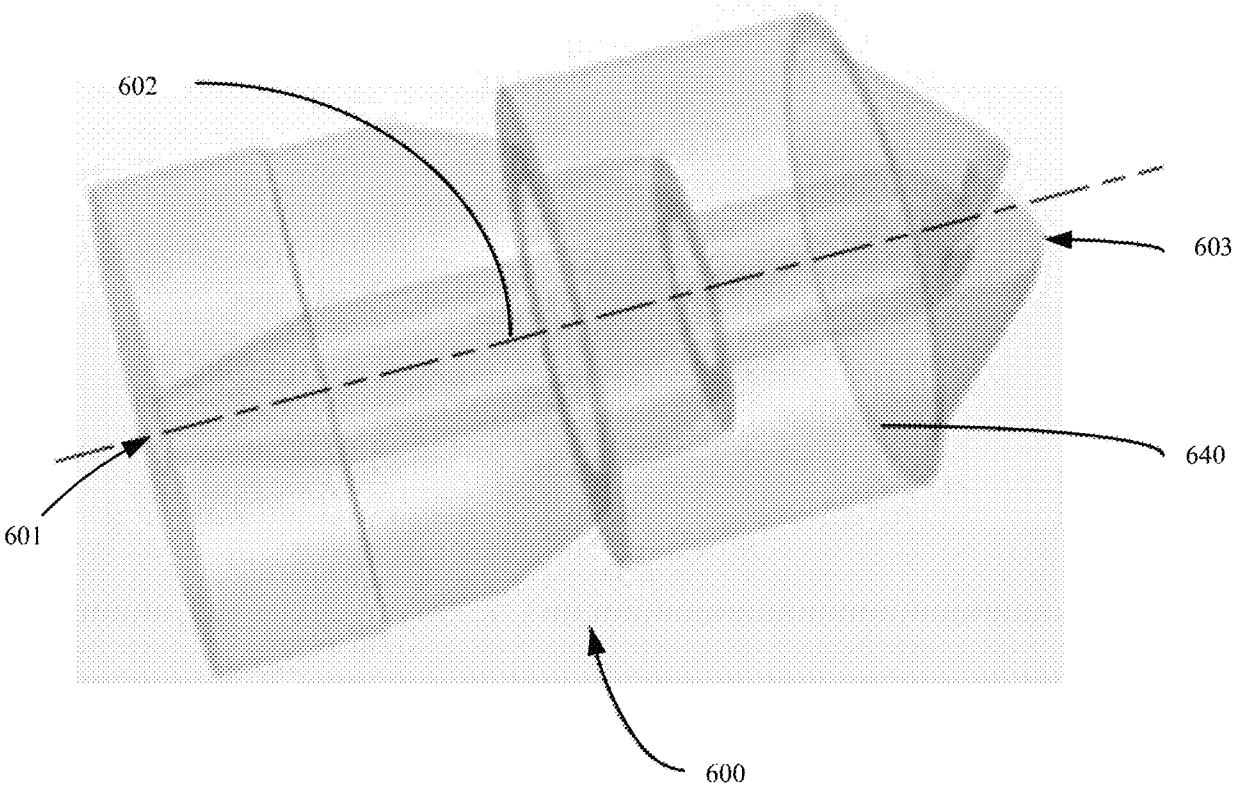
FIG. 5A illustrates a fifth alternative embodiment of a spray tip configuration in accordance with one embodiment of the present invention.
Figure 5B:
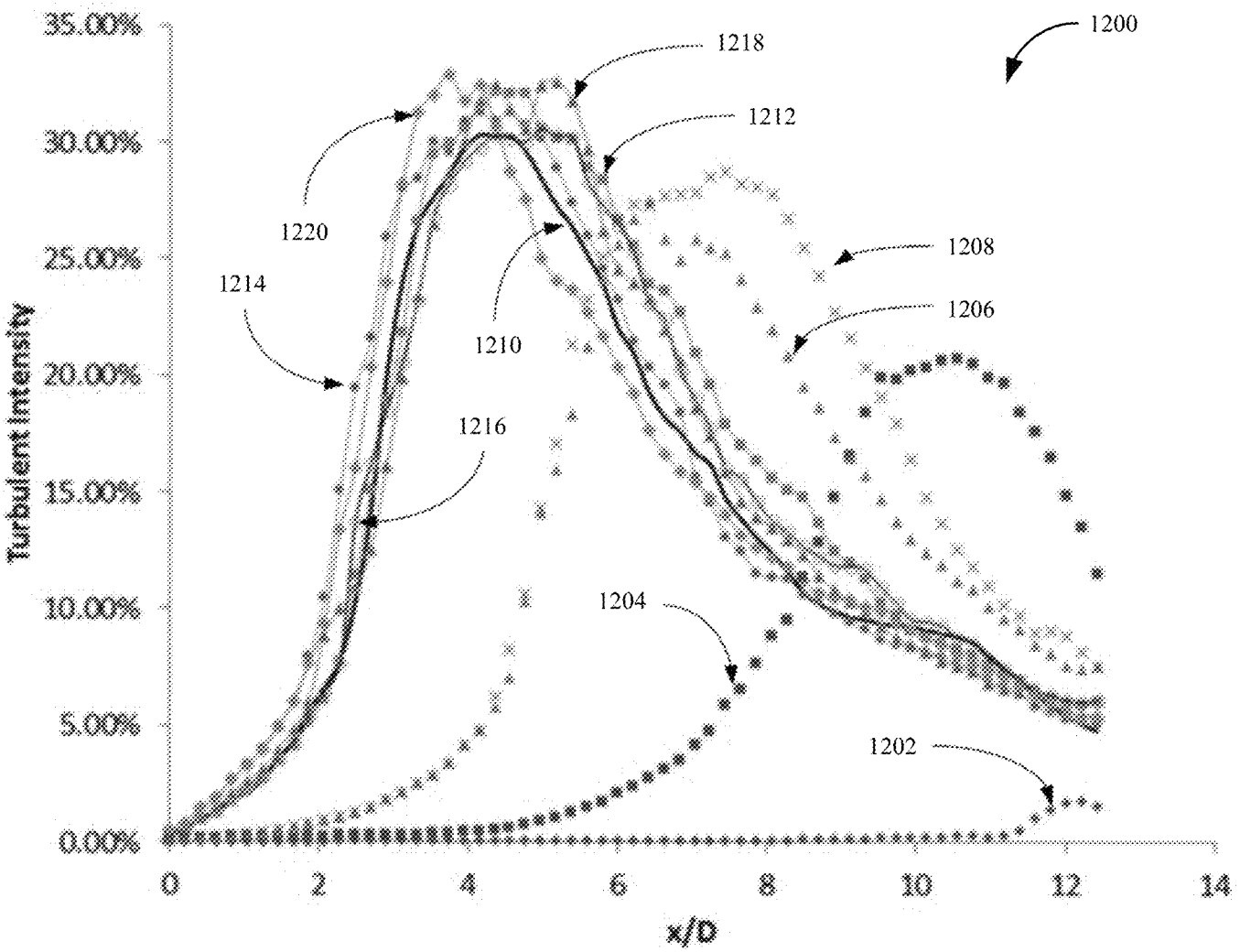
FIGS. 5B-5E illustrate flow patterns in accordance with embodiments of the present invention.

FIG. 5A illustrates a fifth alternative embodiment of a spray tip configuration in accordance with one embodiment of the present invention. As shown in FIG. 5A, in one embodiment, spray tip configuration 600 comprises a center line 602 formed along an interior of pre-orifice spray tip configuration 600, extending from a pre-orifice inlet 601 to an outlet 603.

In one embodiment, spray tip configuration 600 has a turbulence intensity of approximately 5%-10% at the outlet, and a distance from pre-orifice inlet 601 to outlet 603, along center line 602, of approximately between 8D and 14D, where D is the hydraulic diameter of the pre-orifice inlet 601. Such specifications may accelerate spray sheet breakup and eliminate "tailing effects."

In one embodiment, spray tip configuration 600 comprises a cat-eye shaped outlet 603. The approximate turbulent intensity may vary based on the intensity of "tailing effects" produced by the cat-eye tip. Furthermore, in one embodiment, spray tip configuration 600 includes a cat-eye tip that generates light "tailing effects" and spray tip configuration 600 has a turbulent intensity less than 5%. In one embodiment, spray tip configuration 600 includes a cat-eye tip that generates heavy "tailing effects," and spray tip configuration 600 has a turbulent intensity greater than 10%.

In one embodiment, the turbulent intensity of spray tip configuration 600 remains fixed as the diameter varies. In one embodiment, the turbulent decaying speed of spray tip configuration 600 varies as the cross-sectional area varies along the fluid channel within spray tip configuration 600. In one embodiment, an increase in diameter increases the turbulent decaying speed. The increase in turbulent decaying speed caused by an increase in the diameter, in one embodiment, does not alter the intensity of "tailing effects" of spray tip configuration 600.

FIGS. 5B-5E illustrate flow patterns in accordance with embodiments of the present invention. FIG. 5B illustrates a graphical illustration a plurality of flow simulations of fluid flowing through pre-orifice configuration 600, described above with respect to FIG. 5A. In one embodiment, flow simulations are used to determine a critical Reynolds number for a pre-orifice spray tip combined with a specific fluid, for example spray tip configuration 600 combinded with a paint with known viscosity. Turbulence intensity along a center line, from pre-orifice inlet 601 to outlet 603, is calculated and compared for different Reynolds numbers, for example, based on known viscosity of a fluid at the pre-orifice inlet 601.

In one embodiment, the plurality of flow simulations illustrated in FIG. 5B illustrate a laminar flow along curve 1202, corresponding to a Reynolds number of 268 approximately. The flow is transitional for Reynolds numbers along curves 1204, 1206, 1208, and 1210, or, for example, between. Reynolds numbers 464-2400. For Reynolds numbers in the range of approximately 464-2400, the location of peak turbulent intensity along center line 602 moves toward the tip outlet 603 as the Reynolds number increases.

In one embodiment, for curves 1214, 1216, 1218, and 1220, or those with Reynolds numbers approximately greater than 2400, turbulent intensity remains approximately fixed as Reynolds numbers increase, because the flow can be characterized as fully turbulent, or experiencing a maximum turbulence intensity, at some point along the axial distance of the fluid passageway. As Reynolds numbers increase above 2400, the location of the turbulence peak remains constant along center line 602, and the rate of decrease in velocity remain approximately fixed. In one embodiment, turbulence-features may be configured to allow for some dissipation of turbulence in the fluid flow prior to a spray point. In one embodiment, turbulence intensity at the outlet is less than 25% of maximum turbulence. In one embodiment, turbulence intensity is less than 20% of maximum turbulence. In one embodiment, turbulence intensity is at least 5% of maximum turbulence. In one embodiment, turbulence intensity is between 5% and 15% of maximum turbulence In one embodiment, the preferred critical number for a given fluid is the Reynolds at which velocity is uniform at an increasing distance from the peak turbulent location along centerline 602. The critical Reynolds number for the flow simulation of FIG. 5B, for spray tip configuration 600, in one embodiment, is approximately 1200, corresponding to curve 1210. In one embodiment, at a critical Reynolds number of approximately 2400, the peak turbulence location along center line 602 remains relatively fixed as the Reynolds number increases.

As the viscosity of different fluids change, the critical Reynolds number also changes. Because different fluids, with different viscosities, are used for different fluid applications, different spray tip configurations, such as some of the embodiments described herein, may be required at different times. Therefore, for different fluid applications, different spray tip configurations may be required in order to ensure that fully turbulent flow is achieved within the spray tip, and at least some turbulence intensity to decay prior to an outlet.

Figure 5D:
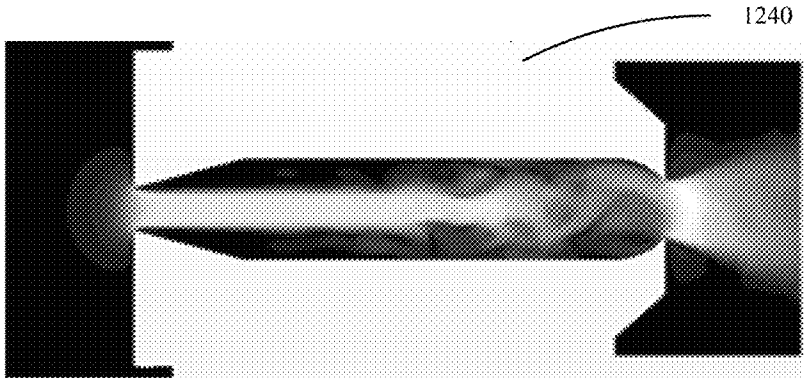
Figure 5C:
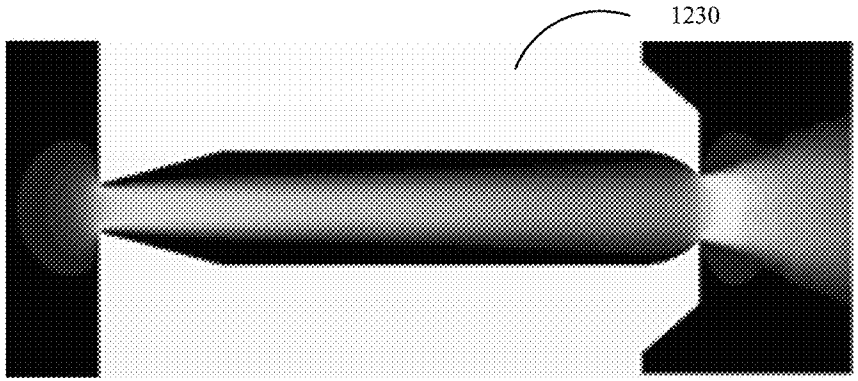
Figure 5E:
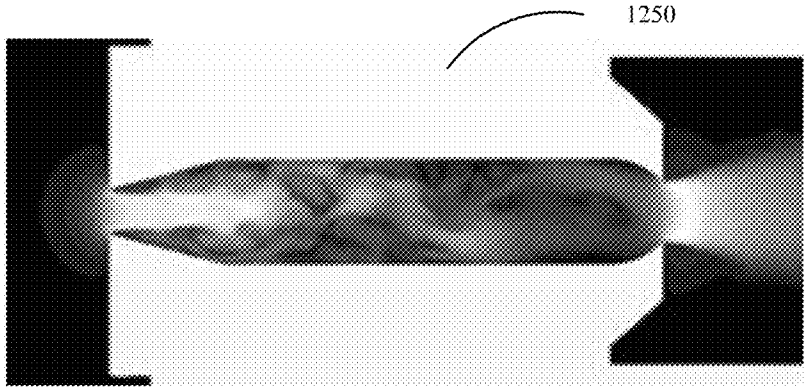

FIG. 5C illustrates an exemplary laminar jet velocity curve 1230 for spray tip configuration 600, at Reynolds number of approximately 268, corresponding to curve 1202 illustrated in FIG. 5B. FIG. 5D illustrates a transitional jet velocity curve 1240, at a Reynolds number of approximately 1120. FIG. 5E illustrates a turbulent jet velocity curve 1250, at a Reynolds number approximately 2936, corresponding to curve 1214 shown in FIG. 5D.

FIGS. 6-9 illustrate a set of spray tip configurations designed to produce a desired turbulence intensity at the spray tip outlet for use with a spray gun dispensing latex paint. Other fluids, such as oil-based paints or acrylic-based paints, may require differently-configured spray tip configurations, based on the known viscosity of the fluid to be dispensed.

Figure 6A:
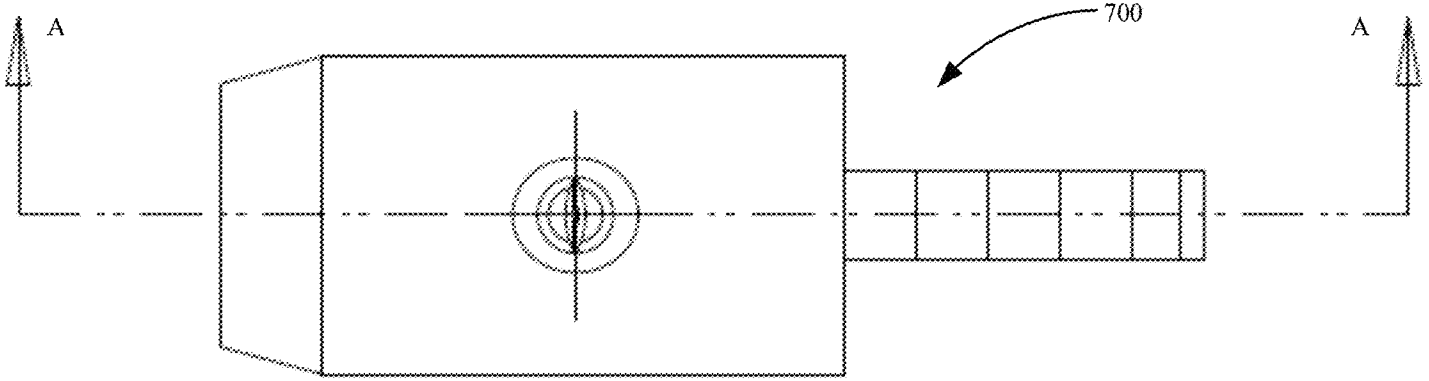
FIGS. 6A-6C illustrate a sixth embodiment of a spray tip configuration in accordance with one embodiment of the present invention.
Figure 6B:
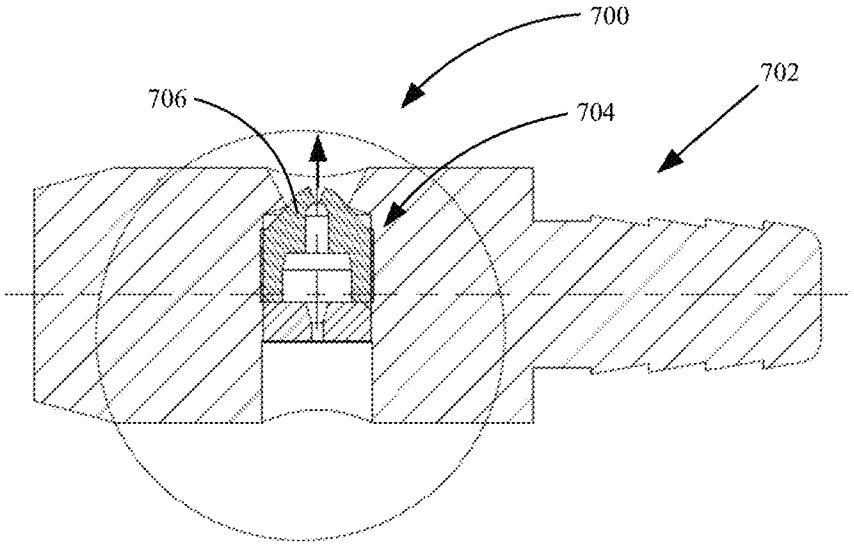
Figure 6C:
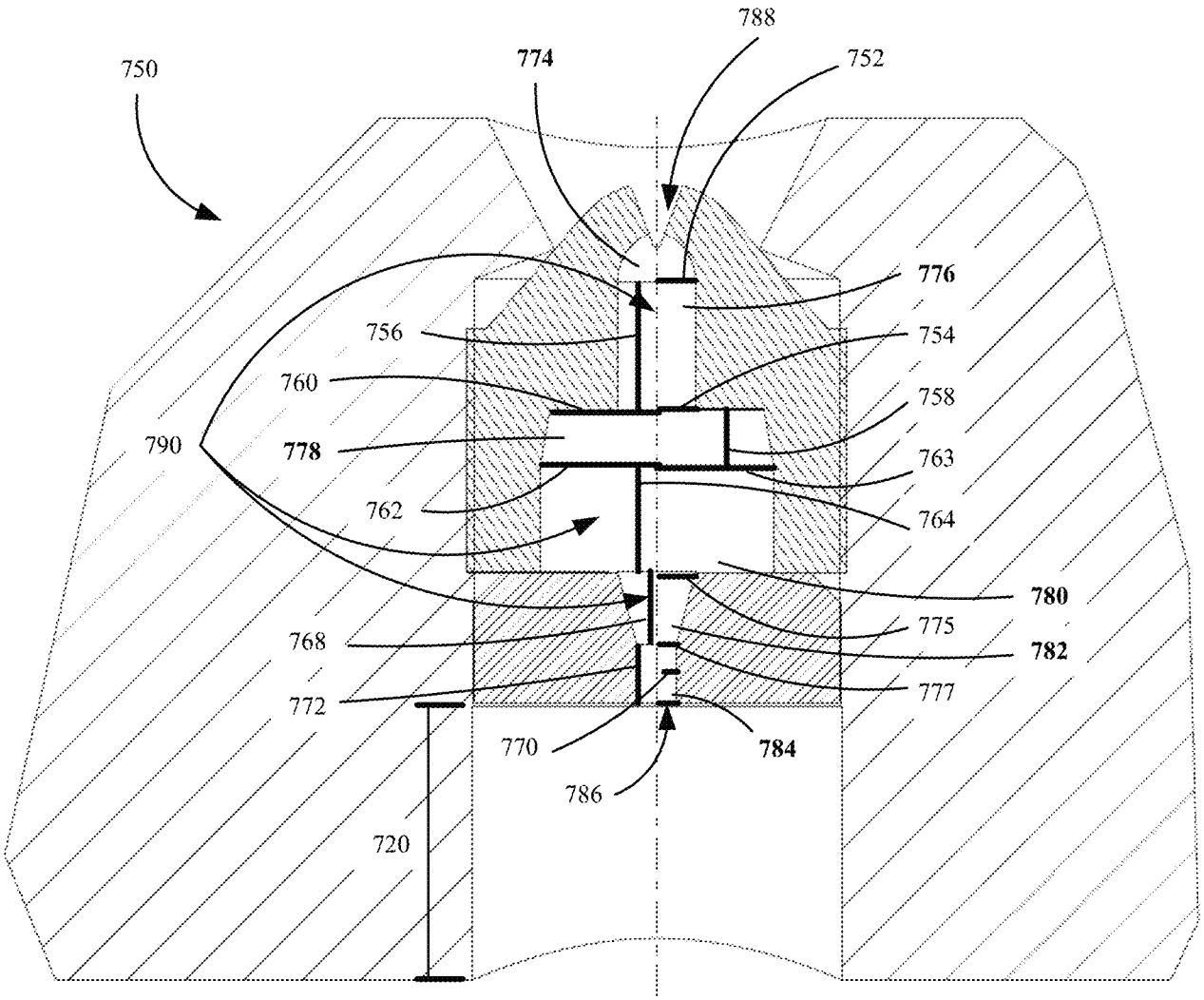

FIGS. 6A-6C illustrate a sixth embodiment of a spray tip configuration in accordance with one embodiment of the present invention. FIG. 6A illustrates an example pre-orifice spray tip configuration 700 which may, for example, couple to a spray gun such as spray gun 10, in one embodiment, as part of a fluid spraying system. Spray tip configuration 700 may, for example, produce a narrow fan width spray pattern at a low flow rate. The width of the spray pattern may be substantially between 10 and 12 inches, and the flow rate may be approximately 0.18 gallons per minute.

FIG. 6B illustrates a cut-away view of spray tip configuration 700, for example taken along section A-A, shown in FIG. 6A. In one embodiment, spray tip configuration 700 comprises a stem 702 and a pre-orifice configuration 706. In one embodiment, pre-orifice configuration 706 is configured to fit within an insert space 704, such that pressurized fluid is received and passes through pre-orifice configuration 706 before exiting an outlet of a spray gun.

FIG. 6C illustrates a close up view 750 of a pre-orifice configuration, for example pre-orifice configuration 706 shown in FIG. 6B. In one embodiment, pre-orifice configuration 706 comprises a channel 790 defined, at least in part, by some or all of portions 774, 776, 778, 780, 782, and 784 coupled, respectively, between an outlet 788, and an inlet 786. However, in another embodiment, channel 790 comprises additional portions, or only a subset of portions: 774, 776, 778, 780, 782, and 784.

In one embodiment, portion 784 receives fluid from inlet 786, and provides the fluid flow through portions 782, 780, 778, 778, and 776, respectively, to portion 774, which provides fluid flow to outlet orifice 788.

In accordance with one embodiment, portions 774, 776, 778, 780, 782, and 784 comprise geometric features configured to provide turbulence-increasing features configured to increase turbulence in fluid flow through channel 790.

Turbulence increasing features may reduce tailing effects experienced by a user, thereby increasing spray pattern uniformity. In one embodiment, turbulence-features may be configured to develop a fully-turbulent flow, and allow for some dissipation of turbulence in the fluid flow prior to a spray point. In one embodiment, turbulence intensity at the outlet is less than 25% of maximum turbulence. In one embodiment, turbulence intensity is less than 20% of maximum turbulence. In one embodiment, turbulence intensity is at least 5% of maximum turbulence. In one embodiment, turbulence intensity is between 5% and 15% of maximum turbulence.

In one embodiment, channel 790 is partially defined by a portion 784. Portion 784 comprises a cylinder defined by a radius 770 and an axial distance 772. In one embodiment, radius 770 is substantially equal to a radius of inlet 786. In one embodiment, portion 784 is fluidically coupled, on a first end, to inlet 786, and, on a second end, to portion 782. FIG. 6C illustrates a cylindrical-shaped portion 784. However, other appropriate configurations may be used. For example, in one embodiment, portion 784 comprises a generalized geometry with a hydraulic diameter defined by an effective radius 770. However, in other embodiments, portion 784 comprises other appropriate configurations, for example a square cross-section, or an oval-cross section. In one embodiment, portion 784 is defined by two hydraulic diameters, on a first and second end, connected by a generalized surface.

In one embodiment, channel 790 is partially defined by a portion 782. Portion 782 comprises a truncated cone defined by a first radius 777, a second radius 775, and an axial distance 768. In one embodiment, radius 777 is smaller than radius 775. In one embodiment, radius 777 is substantially equal to radius 770. In one embodiment, radius 777 is larger than radius 770. In one embodiment, radius 777 is smaller than radius 770. In one embodiment, portion 782 is fluidically coupled, on a first end, to portion 784, and, on a second end, to portion 780. FIG. 6C illustrates a cone-shaped portion 782. However, other appropriate configurations may be used, in other embodiments, to provide an expansion chamber. For example, a pyramidal structure with a square or rectangle cross-section, or a cone with an ovular cross-section. Portion 782 may also comprise a parabolic-shaped portion. In another embodiment, instead of a smooth surface, portion 782 may comprise a net-expanding cross-section along the distance between radius 777 and radius 775, with local contractions or constant-cross section portions. In one embodiment, a cone-shape provides ease in manufacturing.

In one embodiment, channel 790 is partially defined by portion 780. Portion 780 comprises a cylinder defined by a radius 763 and an axial distance 764. In one embodiment, radius 763 is substantially larger than radius 775. In one embodiment, portion 780 is fluidically coupled, on a first side, to portion 782, and, on a second side, to portion 778. FIG. 6C illustrates a cylindrical-shaped portion 780. However, other appropriate configurations may be used. For example, in one embodiment, portion 780 comprises a generalized geometry with a hydraulic diameter defined by an effective radius 763. However, in other embodiments, portion 780 comprises other appropriate configurations, for example a square cross-section, or an oval-cross section. In one embodiment, portion 780 is defined by two hydraulic diameters, on a first and second end, connected by a generalized surface.

In one embodiment, channel 790 is partially defined by portion 778. Portion 778 comprises a truncated cone defined by a first radius 762, a second radius 760, and an axial distance 758. In one embodiment, radius 762 is larger than radius 763. In one embodiment, radius 762 is larger than radius 760. In one embodiment, portion 778 is fluidically coupled, on a first end, to portion 780, and, on a second end, to portion 776. FIG. 6C illustrates a cone-shaped portion 778. However, other appropriate configurations may be used, in other embodiments, to provide an expansion chamber. For example, a pyramidal structure with a square or rectangle cross-section, or a cone with an ovular cross-section. Portion 778 may also comprise a parabolic-shaped portion. In another embodiment, instead of a smooth surface, portion 778 may comprise a net-contracting cross-section along the distance between radius 762 and radius 760, with local expansions or constant-cross section portions. In one embodiment, a cone-shape provides ease in manufacturing.

In one embodiment, channel 790 is partially defined by portion 776. Portion 776 comprises a cylinder defined by a radius 754 and an axial distance 756. In one embodiment, radius 754 is substantially smaller than radius 760. In one embodiment, portion 776 is coupled, on a first end, to portion 778, and, on a second end, to portion 774. FIG. 6C illustrates a cylindrical-shaped portion 776. However, other appropriate configurations may be used. For example, in one embodiment, portion 776 comprises a generalized geometry with a hydraulic diameter defined by an effective radius 754. However, in other embodiments, portion 780 comprises other appropriate configurations, for example a square cross-section, or an oval-cross section. In one embodiment, portion 776 is defined by two hydraulic diameters, on a first and second end, connected by a generalized surface.

In one embodiment, channel 790 is partially defined by portion 774. Portion 774 comprises a section of a spheroid defined by a radius 752. In one embodiment, portion 774 is a section of a prolate spheroid. In one embodiment, portion 724 is a section of an oblate spheroid. In one embodiment, portion 774 is a section of a perfect spheroid. In one embodiment, radius 752 is substantially equal to radius 754. In one embodiment, radius 752 is larger than radius 754. In one embodiment, radius 752 is smaller than radius 754. In another embodiment, the spheroid section comprising portion 774 is made imperfect by creases or asymmetries. However, while FIG. 6C illustrates a spherical portion 774, other appropriate geometries may be used in other embodiments. For example, portion 774 may comprise a trapezoidal prism, or a creased spheroid, in another embodiment.

In one embodiment, all of axial distances 772, 768, 764, 758, 756, and radius 752 are substantially equal. In another embodiment, at least some of axial distances 772, 768, 764, 758, 756, and radius 752 are different. In another embodiment, all of axial distances 772, 768, 764, 758, 756, and radius 752 are different. In one embodiment, the combined length of axial distances 764, 758, 756, and radius 725 is at least 0.15 inches. In one embodiment, the combined length of axial distances 764, 758, 756, and radius 725 is at least 0.16 inches. In one embodiment, the combined length of axial distances 764, 758, 756, and radius 725 is at least 0.165 inches. In one embodiment, the combined length of axial distances 764, 758, 756, and radius 725 is at least 0.166 inches. In one embodiment, the combined length of axial distances 764, 758, 756, and radius 725 is less than 0.17 inches. In one embodiment, the radii of the adjoining portions comprising channel 790 belong to cylindrical geometries. In another embodiment, the radii of the adjoining portions comprising channel 790 are effective radii of a hydraulic diameter belonging to a generalized cross-sectional area, for example an oval, square, or other appropriate shapes In one embodiment, a pre-orifice space 720, within the insert, measures at least 0.13 inches. In one embodiment, pre-orifice space 720 measures at least 0.14 inches. In one embodiment, pre-orifice space 720 measures no more than 0.15 inches. In one embodiment, pre-orifice space 720 measures at least 0.142 inches.

Figure 7A:
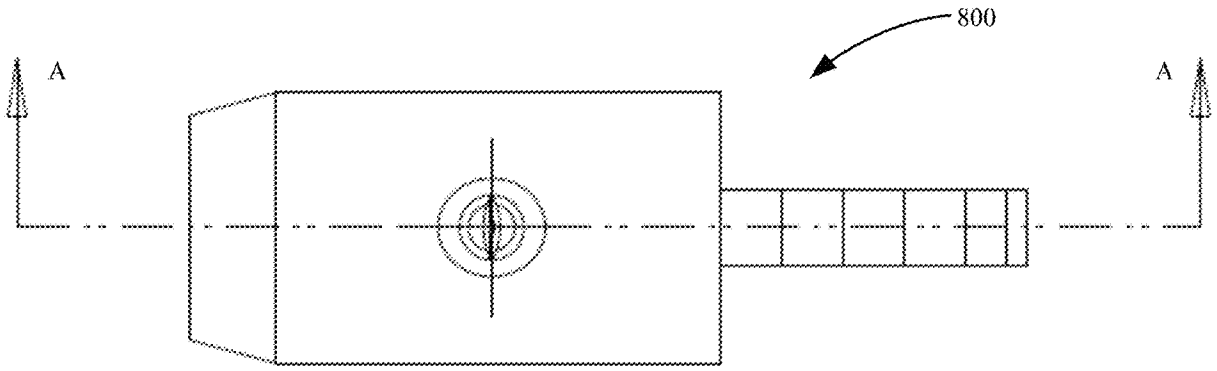
FIGS. 7A-7C illustrate a seventh embodiment of a spray tip configuration in accordance with one embodiment of the present invention.
Figure 7B:
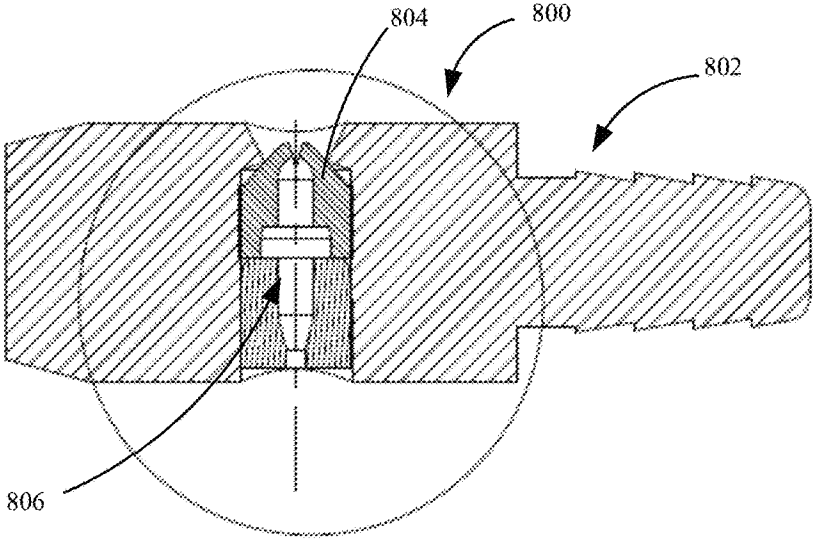
Figure 7C:
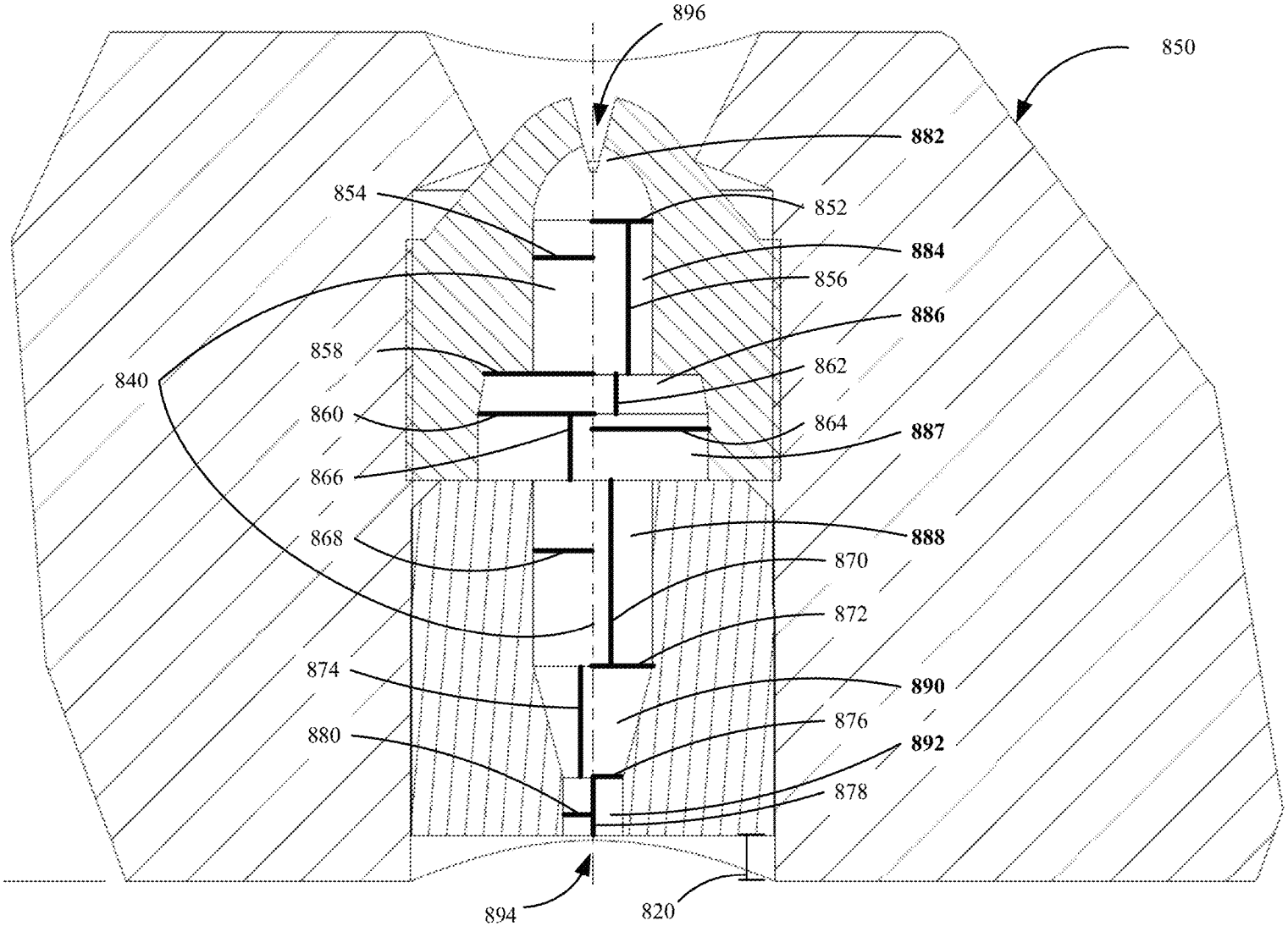

FIGS. 7A-7C illustrate a seventh embodiment of a spray tip configuration in accordance with one embodiment of the present invention. FIG. 7A illustrates one example of a spray tip configuration 800 that may be coupled to a spray gun, for example spray gun 10, in accordance with one embodiment of the present invention. Spray tip configuration 800 may, for example, produce a wide fan width spray pattern at a high flow rate. The width of the spray pattern may be substantially between 16 and 18 inches, and the flow rate may be approximately 0.39 gallons per minute.

FIG. 7B illustrates a cut-away view of spray tip configuration 800. In one embodiment, spray tip 800 comprises a stem 802, a pre-orifice configuration 806 configured to fit within an insert portion 804 of spray tip configuration 800.

FIG. 7C illustrates an enlarged view 850 of pre-orifice configuration 806. In one embodiment, pre-orifice configuration 806 comprises a channel 840 that is defined, in one embodiment, by all, or a subset of, portions 892, 890, 888, 887, 886, 884, and 882. However, in another embodiment, channel 840 may comprise additional portions, or only a subset of portions: 892, 890, 888, 887, 886, 884, and 882. Portions 892, 890, 888, 887, 886, 884, and 882 may, in one embodiment, fluidically couple together to form a channel between an inlet 894, on a first end, and an outlet 896, on a second end.

In one embodiment, portion 892 receives fluid from inlet 894, and provides the fluid flow through portions 890, 888, 887, 886, 884, respectively, to portion 882, which provides fluid flow to outlet orifice 896.

In accordance with one embodiment, portions 892, 890, 888, 887, 886, 884, and 882 comprise geometric features configured to provide turbulence-increasing features configured to increase turbulence in fluid flow through channel 840. Turbulence increasing features may reduce tailing effects experienced by a user, thereby increasing spray pattern uniformity. In one embodiment, turbulence-features may be configured to develop a fully-turbulent flow, and allow for some dissipation of turbulence in the fluid flow prior to a spray point. In one embodiment, turbulence intensity at the outlet is less than 25% of maximum turbulence. In one embodiment, turbulence intensity is less than 20% of maximum turbulence. In one embodiment, turbulence intensity is at least 5% of maximum turbulence. In one embodiment, turbulence intensity is between 5% and 15% of maximum turbulence.

In one embodiment, channel 840 is partially defined by a portion 892. Portion 892 comprises a cylinder defined by a radius 880 and an axial distance 878. In one embodiment, radius 880 is substantially equal to a radius at inlet 894. In one embodiment, portion 890 is fluidically coupled, on a first end, to inlet 894, and, on a second end, to portion 890. FIG. 7C illustrates a cylindrical-shaped portion 892. However, other appropriate configurations may be used. For example, in one embodiment, portion 892 comprises a generalized geometry with a hydraulic diameter defined by an effective radius 880. However, in other embodiments, portion 892 comprises other appropriate configurations, for example a square cross-section, or an oval-cross section. In one embodiment, portion 892 is defined by two hydraulic diameters, on a first and second end, connected by a generalized surface.

In one embodiment, channel 840 is partially defined by a portion 890. Portion 890 comprises a truncated cone defined by a first radius 876, a second radius 872, and an axial distance 874. In one embodiment, radius 876 is smaller than radius 872. In one embodiment, radius 876 is substantially equal to radius 880. In one embodiment, radius 876 is larger than radius 880. In one embodiment, radius 876 is smaller than radius 880. In one embodiment, portion 890 is fluidically coupled, on a first end, to portion 892, and, on a second end, to portion 888. FIG. 27C illustrates a cone-shaped portion 890. However, other appropriate configurations may be used, in other embodiments, to provide an expansion chamber. For example, a pyramidal structure with a square or rectangle cross-section, or a cone with an ovular cross-section. Portion 890 may also comprise a parabolic-shaped portion. In another embodiment, instead of a smooth surface, portion 890 may comprise a net-expanding cross-section along the distance between radius 876 and radius 872, with local contractions or constant-cross section portions. In one embodiment, a cone-shape provides ease in manufacturing.

In one embodiment, channel 840 is partially defined by a portion 888. Portion 888 comprises a cylinder defined by a radius 868 and an axial distance 870. In one embodiment, radius 868 is substantially equal to radius 872. In one embodiment, radius 868 is larger than radius 872. In one embodiment, radius 868 is smaller than radius 872. In one embodiment, portion 888 is fluidically coupled, on a first end, to portion 890, and, on a second end, to portion 887. FIG. 7C illustrates a cylindrical-shaped portion 888. However, other appropriate configurations may be used. For example, in one embodiment, portion 888 comprises a generalized geometry with a hydraulic diameter defined by an effective radius 868. However, in other embodiments, portion 888 comprises other appropriate configurations, for example a square cross-section, or an oval-cross section. In one embodiment, portion 888 is defined by two hydraulic diameters, on a first and second end, connected by a generalized surface.

In one embodiment, channel 840 is partially defined by a portion 887. Portion 887 comprises a cylinder defined by a radius 864 and an axial distance 866. In one embodiment, radius 864 is substantially larger than radius 868. In one embodiment, portion 887 is fluidically coupled, on a first end, to portion 888, and, on a second end, to portion 884. FIG. 7C illustrates a cylindrical-shaped portion 887. However, other appropriate configurations may be used. For example, in one embodiment, portion 887 comprises a generalized geometry with a hydraulic diameter defined by an effective radius 864. However, in other embodiments, portion 887 comprises other appropriate configurations, for example a square cross-section, or an oval-cross section. In one embodiment, portion 887 is defined by two hydraulic diameters, on a first and second end, connected by a generalized surface.

In one embodiment, channel 840 is partially defined by a portion 886. Portion 886 comprises a truncated cone defined by a first radius 860, a second radius 858, and an axial distance 862. In one embodiment, radius 860 is substantially equal to radius 864. In one embodiment, radius 860 is larger than radius 864. In one embodiment, radius 860 is smaller than radius 864. In one embodiment, radius 860 is larger than radius 858. In one embodiment, portion 886 is fluidically coupled, on a first end, to portion 887, and, on a second end, to portion 884. FIG. 7C illustrates a cone-shaped portion 886. However, other appropriate configurations may be used, in other embodiments, to provide an expansion chamber. For example, a pyramidal structure with a square or rectangle cross-section, or a cone with an ovular cross-section. Portion 886 may also comprise a parabolic-shaped portion. In another embodiment, instead of a smooth surface, portion 886 may comprise a net-contracting cross-section along the distance between radius 860 and radius 858, with local expansions or constant-cross section portions. In one embodiment, a cone-shape provides ease in manufacturing.

In one embodiment, channel 840 is partially defined by a portion 884. Portion 884 comprises a cylinder defined by a radius 854 and an axial distance 856. In one embodiment, the radius 854 is substantially smaller than radius 858. In one embodiment, portion 884 is fluidically coupled, on a first end, to portion 886, and, on a second end, to portion 882. FIG. 7C illustrates a cylindrical-shaped portion 884. However, other appropriate configurations may be used. For example, in one embodiment, portion 884 comprises a generalized geometry with a hydraulic diameter defined by an effective radius 854. However, in other embodiments, portion 884 comprises other appropriate configurations, for example a square cross-section, or an oval-cross section. In one embodiment, portion 884 is defined by two hydraulic diameters, on a first and second end, connected by a generalized surface.

In one embodiment, channel 840 is partially defined by a portion 882. Portion 882 comprises a section of a spheroid defined by a radius 852. In one embodiment, radius 852 is substantially equal to radius 854. In one embodiment, radius 852 is smaller than radius 854. In one embodiment, radius 852 is larger than radius 854. In one embodiment, portion 882 comprises a section of an oblate spheroid. In one embodiment, portion 882 comprises a section of a prolate spheroid. In one embodiment, portion 882 comprises a section of a perfect spheroid. In one embodiment, portion 882 comprises outlet 896. In another embodiment, the spheroid section comprising portion 882 is made imperfect by creases or asymmetries. However, while FIG. 7C illustrates a spherical portion 882, other appropriate geometries may be used in other embodiments. For example, portion 882 may comprise a trapezoidal prism, or a creased spheroid, in another embodiment.

In one embodiment, all of axial distances 878, 874, 870, 866, 856, and radius 852 are substantially equal. In another embodiment, at least some of axial distances 878, 874, 870, 866, 856, and radius 852 are different. In another embodiment, all of axial distances 878, 874, 870, 866, 856, and radius 852 are different. In one embodiment, the combined length of axial distances 870, 866, 856, and radius 852 is at least 0.24 inches. In one embodiment, the combined length of axial distances 870, 866, 856, and radius 852 is at least 0.25 inches. In one embodiment, the combined length of axial distances 870, 866, 856, and radius 852 is at least 0.257 inches. In one embodiment, the combined length of axial distances 870, 866, 856, and radius 852 is less than 0.26 inches. In one embodiment, the radii of the adjoining portions comprising channel 840 belong to cylindrical geometries. In another embodiment, the radii of the adjoining portions comprising channel 840 are effective radii of a hydraulic diameter belonging to a generalized cross-sectional area, for example an oval, square, or other appropriate shapes In one embodiment, a pre-orifice space 820, within the insert, measures at least 0.01 inches. In one embodiment, pre-orifice space 820 measures at least 0.02 inches. In one embodiment, pre-orifice space 820 measures no more than 0.025 inches. In one embodiment, pre-orifice space 820 measures at least 0.024 inches.

Figure 8A:
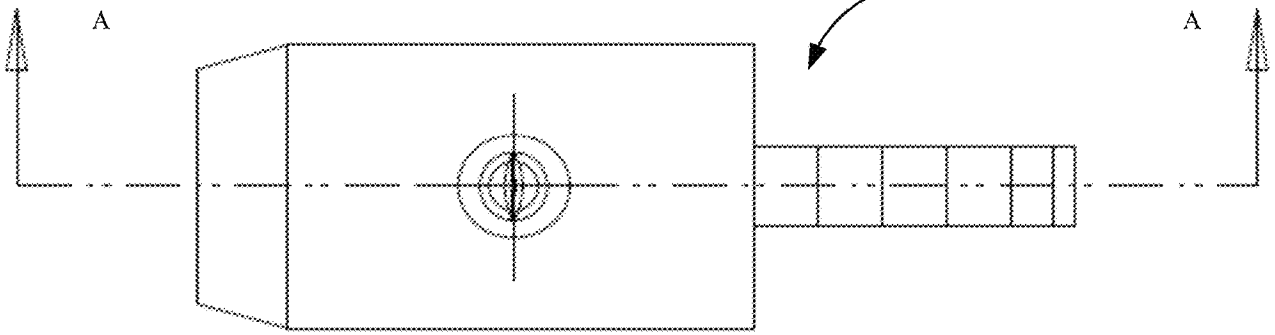
FIGS. 8A-8C illustrate an eighth embodiment of a spray tip configuration in accordance with one embodiment of the present invention.
Figure 8B:
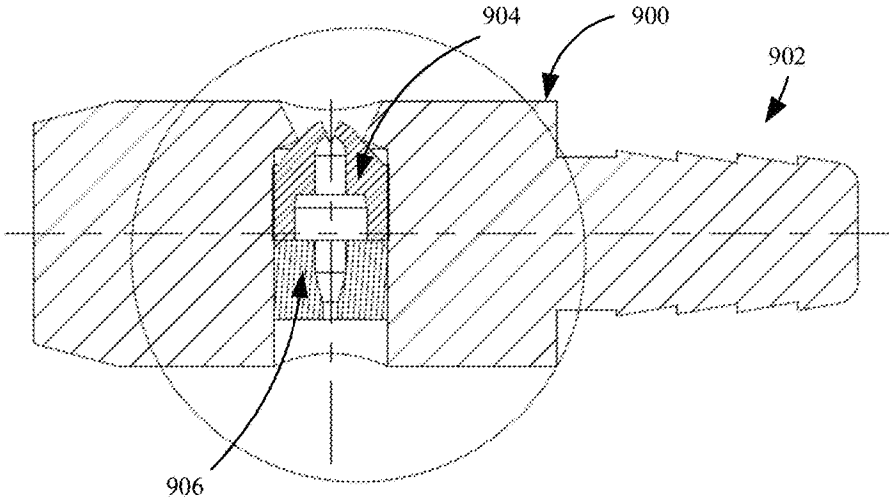
Figure 8C:
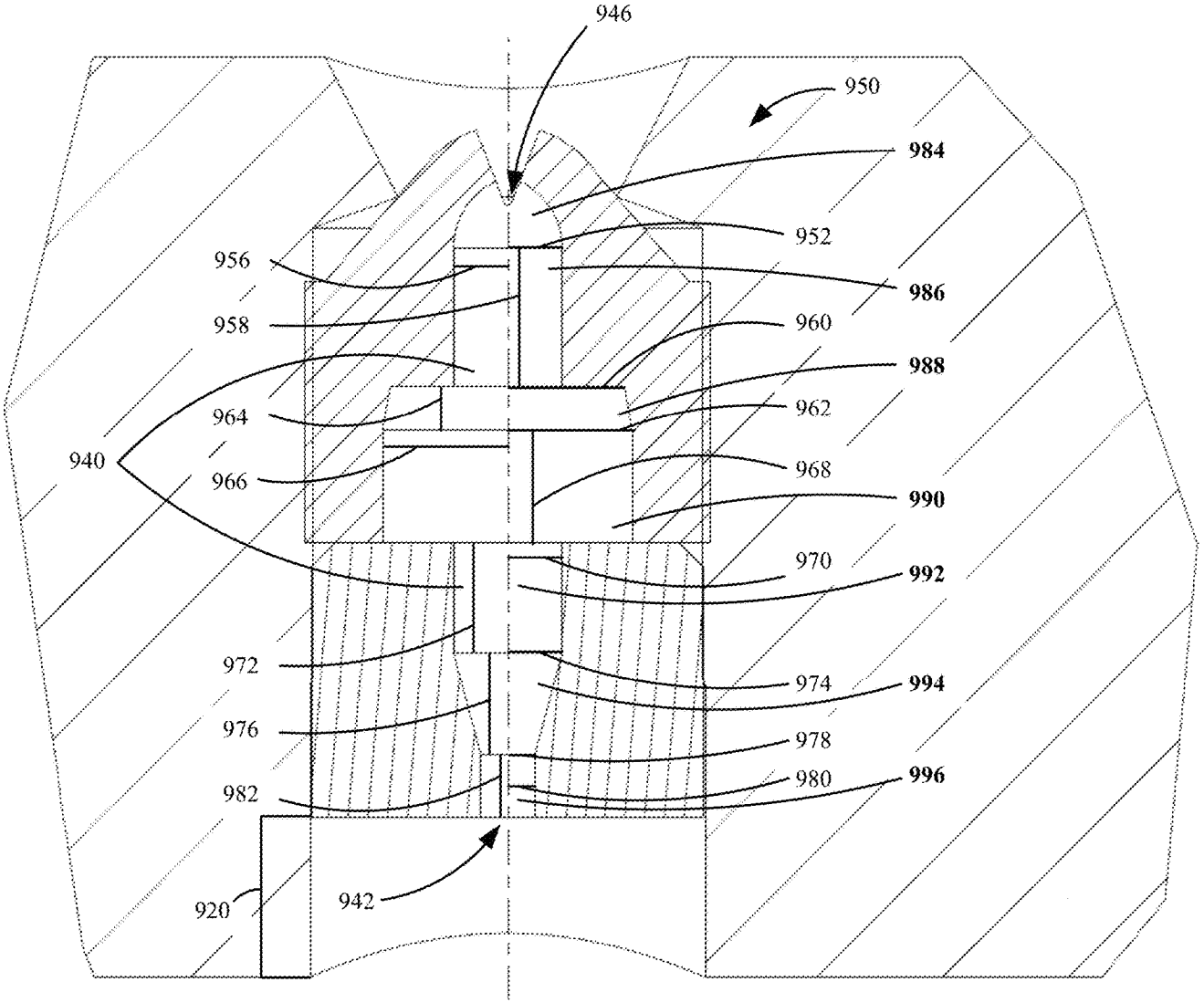

FIGS. 8A-8C illustrate an eighth embodiment of a spray tip configuration in accordance with one embodiment of the present invention. FIG. 8A illustrates an exemplary spray tip configuration 900, which may, for example, couple to a spray gun such as spray gun 10 shown in FIG. 1. Spray tip 900 may, in one embodiment, be configured to bring a fluid to a desired turbulence intensity flow for a spray operation. Spray tip configuration 900 may, for example, produce a medium fan width spray pattern at a high flow rate. The width of the spray pattern may be substantially between 14 and 16 inches, and the flow rate may be approximately 0.31 gallons per minute.

FIG. 8B illustrates an exemplary cut-away view of spray tip 900. In one embodiment, spray tip 900 comprises a stem 902 and a pre-orifice configuration 906 configured to fit within an insert 904.

FIG. 8C illustrates an enlarged view 950, for example, of area 910 illustrated in FIG. 8B, of pre-orifice configuration 906. In one embodiment, pre-orifice configuration 906 comprises a channel 940 defined by portions 996, 994, 992, 990, 988, 986, and 984. In one embodiment, channel 940 comprises a fluidic coupling between an inlet 942, and an outlet 946, such that fluid flows from inlet 942, respectively, through portions 996, 994, 992, 990, 988, 986, 984, to outlet 946. However, in another embodiment, channel 940 may comprise additional portions, or only a subset of portions: 996, 994, 992, 990, 988, 986, and 984.

Portion 996, in one embodiment, receives fluid flow from an inlet orifice 942, and provides the fluid flow through portions 994, 992, 990, 988, and 986, respectively, to portion 984, which provides fluid flow to outlet orifice 946.

In accordance with one embodiment, portions 996, 994, 992, 990, 988, 986, and 984 comprise geometric features configured to provide turbulence-increasing features configured to increase turbulence in fluid flow through channel 940. Turbulence increasing features may reduce tailing effects experienced by a user, thereby increasing spray pattern uniformity. In one embodiment, turbulence-features may be configured to develop a fully-turbulent flow, and allow for some dissipation of turbulence in the fluid flow prior to a spray point. In one embodiment, turbulence intensity at the outlet is less than 25% of maximum turbulence. In one embodiment, turbulence intensity is less than 20% of maximum turbulence. In one embodiment, turbulence intensity is at least 5% of maximum turbulence. In one embodiment, turbulence intensity is between 5% and 15% of maximum turbulence.

In one embodiment, channel 940 is partially defined by a portion 996. Portion 996 comprises a cylinder with a radius 980 and an axial distance 982. In one embodiment, radius 980 is substantially equal to a radius of inlet 942. In one embodiment, portion 996 is fluidically coupled, on a first end, to inlet 942, and, on a second end, to portion 994. FIG. 8C illustrates a cylindrical-shaped portion 996. However, other appropriate configurations may be used. For example, in one embodiment, portion 996 comprises a generalized geometry with a hydraulic diameter defined by an effective radius 980. However, in other embodiments, portion 996 comprises other appropriate configurations, for example a square cross-section, or an oval-cross section. In one embodiment, portion 996 is defined by two hydraulic diameters, on a first and second end, connected by a generalized surface.

In one embodiment, channel 940 is partially defined by a portion 994. Portion 994 comprises a truncated cone defined by a first radius 978, a second radius 974, and an axial distance 976. In one embodiment, radius 978 is smaller than radius 974. In one embodiment, radius 978 is substantially equal to radius 980. In one embodiment, radius 978 is larger than radius 980. In one embodiment, radius 978 is smaller than radius 980. In one embodiment, portion 994 is fluidically coupled, on a first end, to portion 996, and, on a second end, to portion 992. FIG. 8C illustrates a cone-shaped portion 994. However, other appropriate configurations may be used, in other embodiments, to provide an expansion chamber. For example, a pyramidal structure with a square or rectangle cross-section, or a cone with an ovular cross-section. Portion 994 may also comprise a parabolic-shaped portion. In another embodiment, instead of a smooth surface, portion 994 may comprise a net-expanding cross-section along the distance between radius 978 and radius 974, with local contractions or constant-cross section portions. In one embodiment, a cone-shape provides ease in manufacturing.

In one embodiment, channel 940 is partially defined by a portion 992. Portion 992 comprises a cylinder defined by a radius 970 and an axial distance 972. In one embodiment, radius 970 is substantially equal to radius 974. In one embodiment, radius 970 is smaller than radius 974. In one embodiment, radius 970 is larger than 974. In one embodiment, portion 992 is fluidically coupled, on a first end, to portion 994, and, on a second end, to portion 990. FIG. 8C illustrates a cylindrical-shaped portion 992. However, other appropriate configurations may be used. For example, in one embodiment, portion 992 comprises a generalized geometry with a hydraulic diameter defined by an effective radius 970. However, in other embodiments, portion 992 comprises other appropriate configurations, for example a square cross-section, or an oval-cross section. In one embodiment, portion 992 is defined by two hydraulic diameters, on a first and second end, connected by a generalized surface.

In one embodiment, channel 940 is partially defined by a portion 990. Portion 990 comprises a cylinder defined by a radius 966 and an axial distance 968. In one embodiment, radius 966 is substantially larger than radius 970. In one embodiment, portion 990 is fluidically coupled, on a first end, to portion 992, and, on a second end, to portion 988. FIG. 8C illustrates a cylindrical-shaped portion 990. However, other appropriate configurations may be used. For example, in one embodiment, portion 990 comprises a generalized geometry with a hydraulic diameter defined by an effective radius 966. However, in other embodiments, portion 990 comprises other appropriate configurations, for example a square cross-section, or an oval-cross section. In one embodiment, portion 990 is defined by two hydraulic diameters, on a first and second end, connected by a generalized surface.

In one embodiment, channel 940 is partially defined by a portion 988. Portion 988 comprises a truncated cone defined by a first radius 962, a second radius 960, and an axial distance 964. In one embodiment, radius 962 is substantially equal to radius 966. In one embodiment, radius 962 is smaller than radius 966. In one embodiment, radius 962 is larger than radius 966. In one embodiment, radius 962 is larger than radius 960. In one embodiment, portion 988 is fluidically coupled, on a first end, to portion 990, and, on a second end, to portion 986. FIG. 8C illustrates a cone-shaped portion 988. However, other appropriate configurations may be used, in other embodiments. For example, a pyramidal structure with a square or rectangle cross-section, or a cone with an ovular cross-section. Portion 988 may also comprise a parabolic-shaped portion. In another embodiment, instead of a smooth surface, portion 988 may comprise a net-contracting cross-section along the distance between radius 962 and radius 960, with local expansions or constant-cross section portions. In one embodiment, a cone-shape provides ease in manufacturing.

In one embodiment, channel 940 is partially defined by a portion 986. Portion 986 comprises a cylinder defined by a radius 956 and an axial distance 958. In one embodiment, radius 956 is substantially smaller than radius 960. In one embodiment, portion 986 is fluidically coupled, on a first end, to portion 988, and, on a second end, to portion 984. FIG. 8C illustrates a cylindrical-shaped portion 986. However, other appropriate configurations may be used. For example, in one embodiment, portion 986 comprises a generalized geometry with a hydraulic diameter defined by an effective radius 954. However, in other embodiments, portion 986 comprises other appropriate configurations, for example a square cross-section, or an oval-cross section. In one embodiment, portion 986 is defined by two hydraulic diameters, on a first and second end, connected by a generalized surface.

In one embodiment, channel 940 is partially defined by a portion 984. Portion 984 comprises a section of a spheroid defined by a radius 952. In one embodiment, radius 952 is substantially equal to radius 956. In one embodiment, radius 952 is larger than radius 956. In one embodiment, radius 952 is smaller than radius 956. In one embodiment, portion 984 comprises a section of an oblate spheroid. In one embodiment, spheroid portion 984 comprises a section of a prolate spheroid. In one embodiment, spheroid 984 comprises a section of a perfect spheroid. In one embodiment, spheroid portion 984 is coupled, on a first end, to portion 986, and, on a second end, to outlet 946. In another embodiment, the spheroid section comprising portion 984 is made imperfect by creases or asymmetries. However, while FIG. 8C illustrates a spherical portion 984, other appropriate geometries may be used in other embodiments. For example, portion 984 may comprise a trapezoidal prism, or a creased spheroid, in another embodiment.

In one embodiment, all of axial distances 982, 976, 972, 968, 964, 958, and radius 952 are substantially equal. In another embodiment, at least some of axial distances 982, 976, 972, 968, 964, 958, and radius 952 are different. In another embodiment, all of axial distances 982, 976, 972, 968, 964, 958, and radius 952 are different. In one embodiment, the combined length of axial distances 972, 968, 964, 958, and radius 952 is at least 0.20 inches. In one embodiment, the combined length of axial distances 972, 968, 964, 958, and radius 952 is at least 0.21 inches. In one embodiment, the combined length of axial distances 972, 968, 964, 958, and radius 952 is at least 0.215 inches. In one embodiment, the combined length of axial distances 972, 968, 964, 958, and radius 952 is less than 0.22 inches. In one embodiment, the radii of the adjoining portions comprising channel 940 belong to cylindrical geometries. In another embodiment, the radii of the adjoining portions comprising channel 940 are effective radii of a hydraulic diameter belonging to a generalized cross-sectional area, for example an oval, square, or other appropriate shapes In one embodiment, a pre-orifice space 920, within the insert, measures at least 0.07 inches. In one embodiment, pre-orifice space 920 measures at least 0.075 inches. In one embodiment, pre-orifice space 920 measures no more than 0.08 inches. In one embodiment, pre-orifice space 920 measures at least 0.077 inches.

Figure 9A:
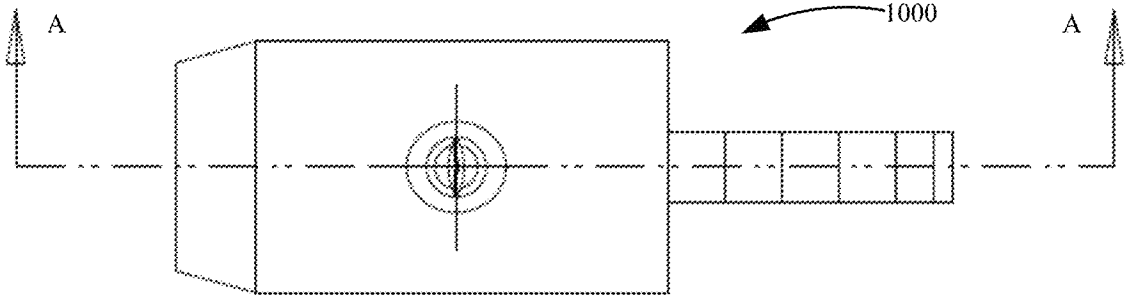
FIGS. 9A-9C illustrate a ninth embodiment of a spray tip configuration in accordance with one embodiment of the present invention.
Figure 9B:
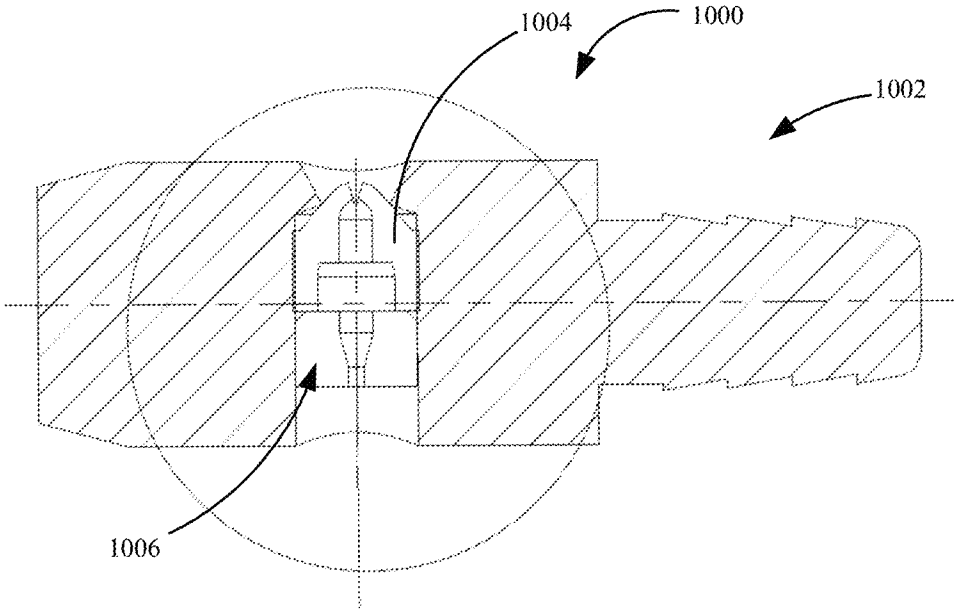
Figure 9C:
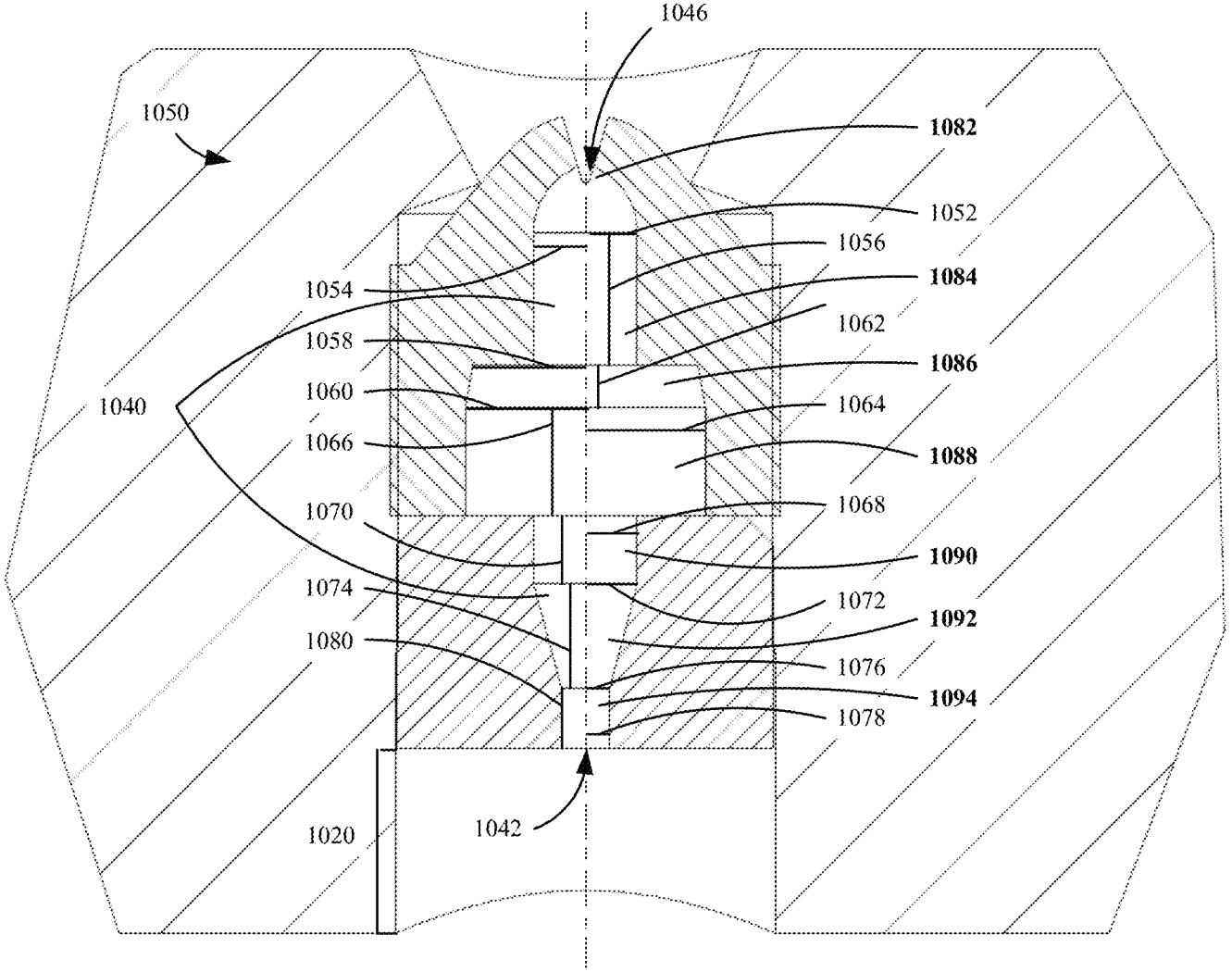

FIGS. 9A-9C illustrate a ninth embodiment of a spray tip configuration in accordance with one embodiment of the present invention. FIG. 9A illustrates an exemplary spray tip configuration 1000 which, in one embodiment, may be coupled to a spray gun, for example spray gun 10 shown in FIG. 1. Spray tip 1000 may, in one embodiment, be configured to bring a fluid to a desired turbulence intensity for a spray operation. Spray tip configuration 1000 may, for example, produce a medium fan width spray pattern at a medium flow rate. The width of the spray pattern may be substantially between 14 and 16 inches, and the flow rate may be approximately 0.24 gallons per minute.

FIG. 9B illustrates a cut-away view of spray tip configuration 1000, for example, taken along line A-A shown in FIG. 9A. In one embodiment, spray tip configuration 1000 comprises a stem 1002, and a pre-orifice configuration 1006 located within an insert 1004.

FIG. 9C illustrates an enlarged view 1050 of spray tip configuration 1000, specifically, of area 1010 shown in FIG. 10B. In one embodiment, pre-orifice configuration 1006 comprises a channel 1040 defined by all, or a subset, of portions 1094, 1092, 1090, 1088, 1086, 1084, and 1082, which may be fluidically coupled to create a fluidic coupling between an inlet 1042, on a first end, to an outlet 1042, on a second end.

Portion 1094, in one embodiment, receives paint flow from an inlet orifice 1042, and provides the fluid flow through portions 1092, 1090, 1088, 1086, and 1084, respectively, to portions 1082, which provides paint flow to outlet orifice 1046.

In accordance with one embodiment, portions 1094, 1092, 1090, 1088, 1086, 1084, and 1082 comprise geometries configured to provide turbulence-increasing features configured to increase turbulence in fluid flow through channel 1040. Turbulence increasing features may reduce tailing effects experienced by a user, thereby increasing spray pattern uniformity. In one embodiment, turbulence-features may be configured to develop a fully-turbulent flow, and allow for some dissipation of turbulence in the fluid flow prior to a spray point. In one embodiment, turbulence intensity at the outlet is less than 25% of maximum turbulence. In one embodiment, turbulence intensity is less than 20% of maximum turbulence. In one embodiment, turbulence intensity is at least 5% of maximum turbulence. In one embodiment, turbulence intensity is between 5% and 15% of maximum turbulence.

In one embodiment, channel 1040 is partially defined by a portion 1094. Portion 1094 comprises a cylinder defined by a radius 1078 and an axial distance 1080. In one embodiment, radius 1078 is substantially equal to a radius of inlet 1042. In one embodiment, portion 1094 is fluidically coupled, on a first end, to inlet 1042, and, on a second end, to portion 1092. FIG. 9C illustrates a cylindrical-shaped portion 1094. However, other appropriate configurations may be used. For example, in one embodiment, portion 1094 comprises a generalized geometry with a hydraulic diameter defined by an effective radius 1078. However, in other embodiments, portion 1094 comprises other appropriate configurations, for example a square cross-section, or an oval-cross section. In one embodiment, portion 1094 is defined by two hydraulic diameters, on a first and second end, connected by a generalized surface.

In one embodiment, channel 1040 is partially defined by a portion 1092. Portion 1092 comprises a truncated cone defined by a first radius 1076, a second radius 1072, and an axial distance 1074. In one embodiment, radius 1076 is substantially equal to radius 1078. In one embodiment, radius 1076 is larger than radius 1078. In one embodiment, radius 1076 is smaller than radius 1078. In one embodiment, radius 1076 is larger than radius 1072. In one embodiment, portion 1092 is fluidically coupled, on a first end, to portion 1094, and, on a second end, to portion 1090. FIG. 9C illustrates a cone-shaped portion 1092. However, other appropriate configurations may be used, in other embodiments, to provide an expansion chamber. For example, a pyramidal structure with a square or rectangle cross-section, or a cone with an ovular cross-section. Portion 1092 may also comprise a parabolic-shaped portion. In another embodiment, instead of a smooth surface, portion 1092 may comprise a net-expanding cross-section along the distance between radius 1076 and radius 1072, with local contractions or constant-cross section portions. In one embodiment, a cone-shape provides ease in manufacturing.

In one embodiment, channel 1040 is partially defined by a portion 1090. Portion 1090 comprises a cylinder defined by a radius 1068 and an axial distance 1070. In one embodiment, radius 1068 is substantially equal to radius 1072. In one embodiment, radius 1068 is smaller than radius 1072. In one embodiment, radius 1068 is larger than radius 1072. In one embodiment, portion 1090 is fluidically coupled, on a first end, to portion 1092, and, on a second end, to portion 1088. FIG. 9C illustrates a cylindrical-shaped portion 1090. However, other appropriate configurations may be used. For example, in one embodiment, portion 1090 comprises a generalized geometry with a hydraulic diameter defined by an effective radius 1068. However, in other embodiments, portion 1090 comprises other appropriate configurations, for example a square cross-section, or an oval-cross section. In one embodiment, portion 1090 is defined by two hydraulic diameters, on a first and second end, connected by a generalized surface.

In one embodiment, channel 1040 is partially defined by a portion 1088. Portion 1088 comprises a cylinder defined by a radius 1064 and an axial distance 1066. In one embodiment, radius 1064 is substantially larger than radius 1068. In one embodiment, portion 1088 is fluidically coupled, on a first end, to portion 1090, and, on a second end, to portion 1086. FIG. 9C illustrates a cylindrical-shaped portion 1088. However, other appropriate configurations may be used. For example, in one embodiment, portion 1088 comprises a generalized geometry with a hydraulic diameter defined by an effective radius 1064. However, in other embodiments, portion 1088 comprises other appropriate configurations, for example a square cross-section, or an oval-cross section. In one embodiment, portion 1088 is defined by two hydraulic diameters, on a first and second end, connected by a generalized surface.

In one embodiment, channel 1040 is partially defined by a portion 1086. Portion 1086 comprises a truncated cone portion defined by a first radius 1060, a second radius 1058 and an axial distance 1062. In one embodiment, radius 1058 is smaller than radius 1060. In one embodiment, radius 1060 is smaller than radius 1064. In one embodiment, radius 1060 is larger than radius 1064. In one embodiment, portion 1086 is fluidically coupled, on a first end, to portion 1088, and, on a second end, to portion 1084. FIG. 9C illustrates a cone-shaped portion 1086. However, other appropriate configurations may be used, in other embodiments. For example, a pyramidal structure with a square or rectangle cross-section, or a cone with an ovular cross-section. Portion 1086 may also comprise a parabolic-shaped portion. In another embodiment, instead of a smooth surface, portion 1086 may comprise a net-contracting cross-section along the distance between radius 1060 and radius 1058, with local expansions or constant-cross section portions. In one embodiment, a cone-shape provides ease in manufacturing.

In one embodiment channel 1040 is partially defined by a portion 1084. Portion 1084 comprises a cylinder defined by a radius 1054 and an axial distance 1056. In one embodiment, radius 1054 is substantially smaller than radius 1058. In one embodiment, portion 1084 is fluidically coupled, on a first end, to portion 1086, and, on a second end, to portion 1082. FIG. 9C illustrates a cylindrical-shaped portion 1084. However, other appropriate configurations may be used. For example, in one embodiment, portion 1084 comprises a generalized geometry with a hydraulic diameter defined by an effective radius 1054. However, in other embodiments, portion 1084 comprises other appropriate configurations, for example a square cross-section, or an oval-cross section. In one embodiment, portion 1084 is defined by two hydraulic diameters, on a first and second end, connected by a generalized surface.

In one embodiment, channel 1040 is partially defined by a portion 1082. Portion 1082 comprises a portion of a spheroid defined by radius 1052. In one embodiment, radius 1052 is substantially equal to radius 1054. In one embodiment, radius 1052 is smaller than radius 1054. In one embodiment, radius 1052 is larger than radius 1054. In one embodiment, portion 1082 comprises a portion of a prolate spheroid. In one embodiment, portion 1082 comprises a portion of an oblate spheroid. In one embodiment, portion 1082 comprises a portion of a perfect spheroid. In one embodiment, portion 1082, is fluidically coupled, on a first end, to portion 1084, and, on a second end, to outlet 1086. In another embodiment, the spheroid section comprising portion 1082 is made imperfect by creases or asymmetries. However, while FIG. 9C illustrates a spherical portion 1082, other appropriate geometries may be used in other embodiments. For example, portion 1082 may comprise a trapezoidal prism, or a creased spheroid, in another embodiment.

In one embodiment, all of axial distances 1080, 1074, 1070, 1066, 1062, 1056, and radius 1052 are substantially equal. In another embodiment, at least some of axial distances 1080, 1074, 1070, 1066, 1062, 1056, and radius 1052 are different. In another embodiment, all of axial distances 1080, 1074, 1070, 1066, 1062, 1056, and radius 1052 are different. In one embodiment, the combined length of axial distances 1070, 1066, 1062, 1056, and radius 1052 is at least 0.18 inches. In one embodiment, the combined length of axial distances 1070, 1066, 1062, 1056, and radius 1052 is at least 0.19 inches. In one embodiment, the combined length of axial distances 764, 1070, 1066, 1062, 1056, and radius 1052 is at least 0.195 inches. In one embodiment, the combined length of axial distances 1070, 1066, 1062, 1056, and radius 1052 is at least 0.200 inches. In one embodiment, the combined length of axial distances 1070, 1066, 1062, 1056, and radius 1052 is less than 0.205 inches. In one embodiment, the radii of the adjoining portions comprising channel 1040 to cylindrical geometries. In another embodiment, the radii of the adjoining portions comprising channel 1040 are effective radii of a hydraulic diameter belonging to a generalized cross-sectional area, for example an oval, square, or other appropriate shapes.

In one embodiment, a pre-orifice space 1020, within the insert, measures at least 0.080 inches. In one embodiment, pre-orifice space 1020 measures at least 0.090 inches. In one embodiment, pre-orifice space 1020 measures no more than 0.095 inches. In one embodiment, pre-orifice space 1020 measures at least 0.092 inches.

Figure 10:
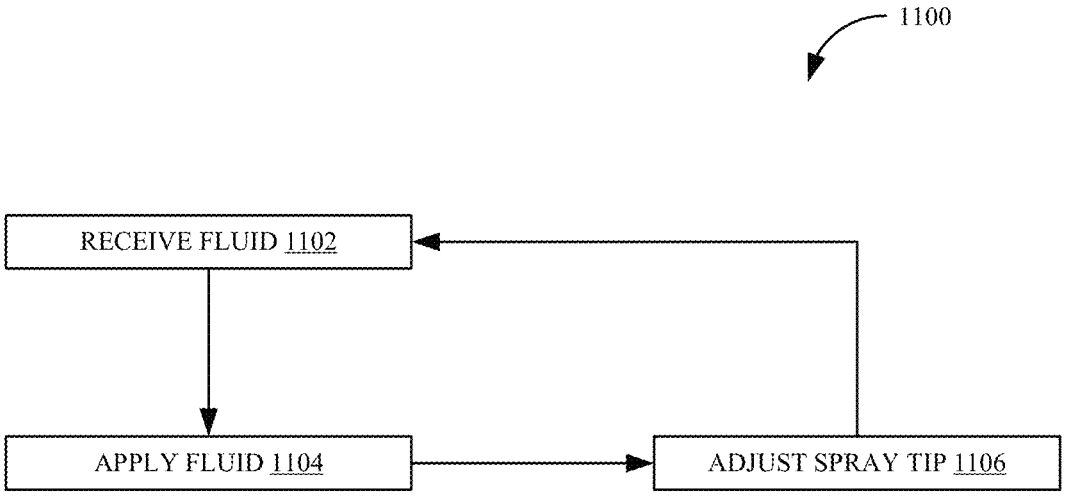
FIG. 10 illustrates a flow diagram of a method for applying fluid using a spray gun with a spray tip configuration in accordance with one embodiment of the present invention.

FIG. 10 illustrates a flow diagram of a method for applying fluid using a spray gun with a spray tip configuration in accordance with one embodiment of the present invention. In one embodiment, method 1100 is be used with low pressure spray tips, for example any of the low pressure spray tip configurations described in FIGS. 1-9. In one embodiment, method 1100 is used with a spray tip kit comprising a plurality of spray tips, each designed for a different paint viscosity.

At block 1102, fluid is received. In one embodiment, receiving fluid comprises a spray gun, for example spray gun 10, receiving fluid at an inlet. The fluid may be pressurized, in one embodiment, at a relatively low spray pressure, for example 1,000 PSI.

At block 1104, the fluid is applied to a surface. In one embodiment, applying fluid comprises a user actuating a trigger of spray gun, for example such that fluid flows from an inlet of a spray gun to an outlet of the spray gun. In one embodiment, applying fluid comprises the pressurized fluid passing through a low pressure spray tip, for example any of the low pressure spray tips described herein, such that a desired turbulence intensity is achieved, and an even spray pattern applied to a surface substantially free of tailing effects.

At block 1106, a spray tip configuration is altered. In one embodiment, altering the spray tip configuration comprises switching one spray tip for another, based on a change in fluid to be used for a given job. For example, a first spray tip may be used during a priming operation, and a second spray tip may be used during a painting operation. As the viscosity of primers differ from the viscosity of paint, different spray tip configurations may be required to ensure a satisfactory spray pattern is achieved.

Figure 11:
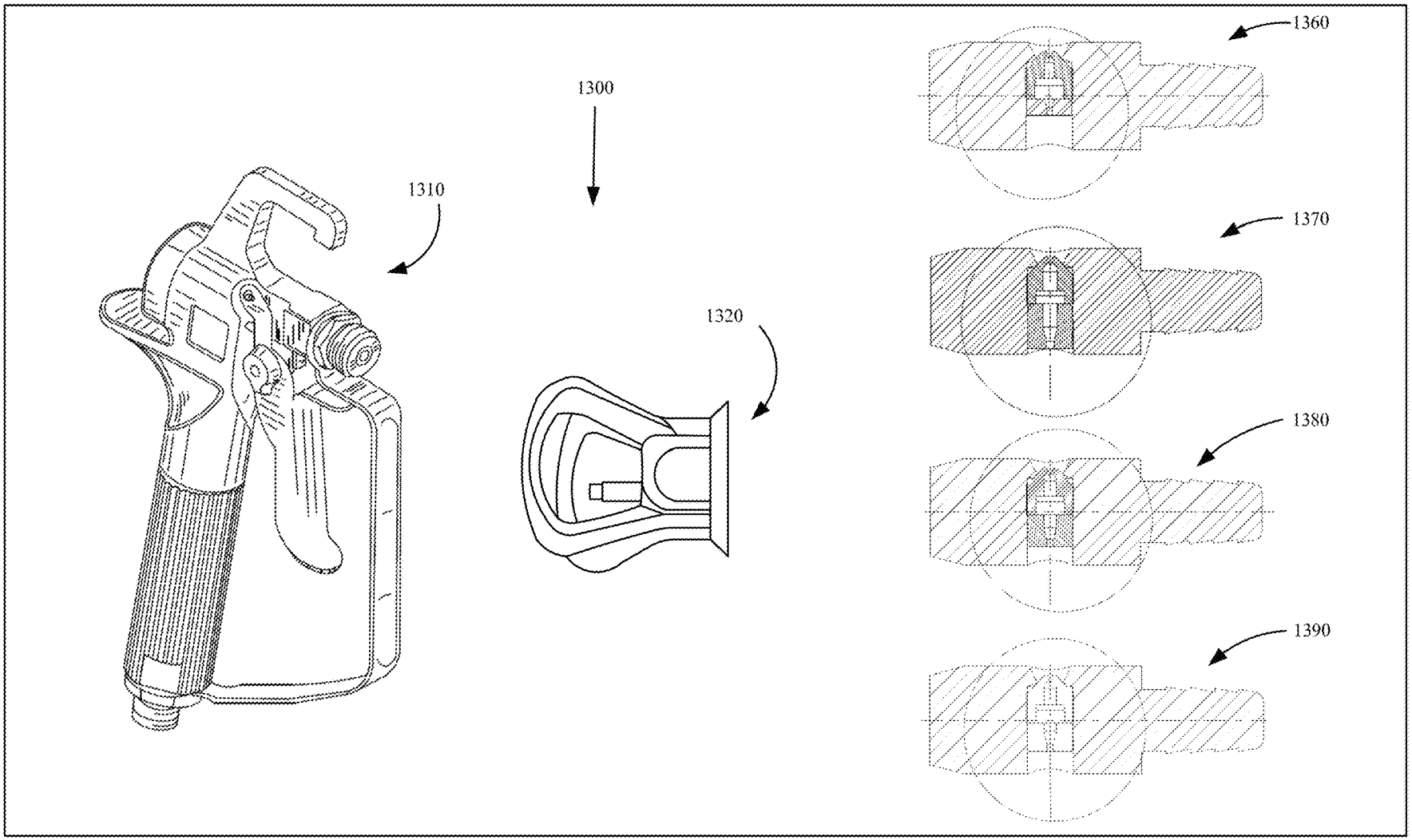
FIG. 11 illustrates an exemplary spray tip kit for a spray gun, in accordance with one embodiment of the present invention.

FIG. 11 illustrates an exemplary spray tip kit for a spray gun, in accordance with one embodiment of the present invention. In one embodiment, kit 1300 comprises one or more removeable spray tip inserts for a spray gun 1310 with spray tip guard 1320. Kit may comprise one or more of spray tip inserts 1360, 1370, 1380 and 1390.

Insert 1360 may correspond, for example, to stem 702, described above with regard to FIG. 6B, and may be configured to provide a narrow fan width spray pattern at a low flow rate. In one embodiment, insert 1360 is configured to provide a fan width of about 10-12 inches at a flow rate of about 0.18 gallons per minute.

Insert 1370 may correspond, for example, to stem 802, described above with regard to FIG. 7B, and may be configured to provide a wide fan width spray pattern at a high flow rate. In one embodiment, insert 1360 is configured to provide a fan width of about 16-18 inches at a flow rate of about 0.39 gallons per minute.

Insert 1380 may correspond, for example, to stem 902, described above with regard to FIG. 8B, and may be configured to provide a medium fan width spray pattern at a high flow rate. In one embodiment, insert 1360 is configured to provide a fan width of about 14-16 inches at a flow rate of about 0.318 gallons per minute.

Insert 1390 may correspond, for example, to stem 1002, described above with regard to FIG. 9B, and may be configured to provide a medium fan width spray pattern at a medium flow rate. In one embodiment, insert 1360 is configured to provide a fan width of about 14-16 inches at a flow rate of about 024 gallons per minute.

In one embodiment, spray tip inserts provided with kit 1200 are removeable, such that a user of spray gun 1310 can select a spray tip in anticipation of a particular spray operation. In one embodiment, kit 1300 is configured with spray tip inserts tailored to a specific fluid. For example, in one embodiment, inserts 1360, 1370, 1380 and 1390 are configured for use with latex paint.

In one embodiment, at least some of spray tip inserts 1360, 1370, 1380 and 1390 are reversible within spray gun 1310, such that a user can more easily clean an insert at the end of a spraying operation.

Kit 1300, illustrated in FIG. 11, comprises four spray tip inserts 1360, 1370, 1380 and 1390. However, in another embodiment, spray tip inserts are each provided separately, such that a user can obtain each individually, as a need arises. In another embodiment, additional spray tip inserts, with different configurations, are provided for a greater variety of spray pattern widths and flow rates. Although the present invention has been described with reference to preferred embodiments, workers skilled in the art will recognize that changes may be made in form and detail without departing from the spirit and scope of the invention.

What is claimed is:

1. An airless spray tip configuration for a low pressure fluid sprayer comprising:

an inlet orifice that receives a fluid;

an outlet orifice that emits the fluid in a spray pattern at a terminal turbulence intensity; and a passageway fluidically coupling the inlet orifice to the outlet orifice, the passageway comprising a plurality of portions that receive the fluid at an initial turbulence intensity, produce a maximum turbulence intensity that is greater than the terminal turbulence and produce the terminal turbulence intensity at the outlet orifice, the plurality of portions comprising:

a first portion comprising an expansion chamber having a cross section that expands from a first hydraulic diameter to a second hydraulic diameter that is larger than the first hydraulic diameter;

a second portion comprising a first cylinder having a third hydraulic diameter that is larger than the second hydraulic, diameter, wherein the second portion is fluidically coupled to, and downstream of the first portion;

a third portion comprising a convergent cross-section that converges from the third hydraulic diameter, to a fourth hydraulic diameter that is smaller than the third hydraulic diameter, wherein the third portion is fluidically coupled to, and downstream of the second portion; and a fourth portion comprising a second cylinder having a fifth hydraulic diameter that is smaller than the fourth hydraulic diameter fluidically coupled to, and immediately downstream of the third portion such that a surface generally perpendicular to the passageway is formed between the third and fourth portion.

2. The airless spray tip configuration of claim 1, and further comprising:

a fifth portion comprising a third cylinder having a diameter equal to the first hydraulic diameter, wherein the fifth portion is fluidically coupled to, upstream of the first portion.

3. The airless spray tip configuration of claim 1, wherein the spray pattern is a uniform spray pattern.

4. The airless spray tip configuration of claim 1, wherein low pressure comprises fluid pressure below 2,000 pounds per square inch (PSI).

5. A method for airlessly spraying a latex paint at low spray pressures, the method comprising the steps of:

receiving, at an inlet of a spray gun, the latex paint pressurized at a low spraying pressure;

actuating the spray gun such that latex paint is discharged in an even spray pattern; and wherein the spray gun comprises a pre-orifice spray tip configuration with a fluid flow channel, and wherein the fluid flow channel comprises a first portion with a first hydraulic diameter, coupled to a second portion with an expanding cross-section from a second hydraulic diameter to a third hydraulic diameter, coupled to a third cylindrical portion immediately downstream of the second portion, with a fourth hydraulic diameter that is larger than the third hydraulic diameter, coupled to a fourth portion with a contracting cross-section, coupled to a fifth portion with a fifth hydraulic diameter, coupled to a spheroid portion.

6. An airless spray tip configuration for a low pressure fluid sprayer comprising:

an inlet configured to receive a fluid;

an outlet orifice configured to emit the fluid in a spray pattern; and a passageway fluidically coupling the inlet to the outlet orifice, such that fluid flows downstream from the inlet to the outlet orifice, the passageway comprising a plurality of fluidically coupled portions, the plurality of portions, in order from upstream to downstream, comprising at least:

a first portion, downstream from the inlet, comprising a first truncated cone configured to provide an expanding cross-sectional area to a first hydraulic diameter as fluid flows through the first portion;

a second portion, comprising a first cylinder, the first cylinder having a second hydraulic diameter, wherein the second hydraulic diameter is larger than the first hydraulic diameter such that a surface generally perpendicular to the passageway is formed between the first portion and second portion;

a third portion comprising a second truncated cone, the second truncated cone narrowing from the second hydraulic diameter at a first end to a third hydraulic diameter at a second end, wherein the third portion is downstream from the second portion;

a fourth portion comprising a second cylinder, wherein the fourth portion is downstream from the third portion; and a fifth portion downstream from the fourth portion, wherein the fifth portion comprises the outlet orifice.

7. The airless spray tip configuration of claim 6, wherein the second truncated cone is configured to provide a contracting cross-sectional area as fluid flows downstream through the third portion.

8. The airless spray tip configuration of claim 6, wherein the fifth portion comprises a partial spheroid portion.

9. The airless spray tip configuration of claim 6, and further comprising a sixth portion, located upstream from the first portion, the sixth portion comprising a third cylinder.

10. The airless spray tip configuration of claim 9, wherein the sixth portion has a sixth portion diameter that is substantially the same as an inlet diameter of the first truncated cone.

11. The airless spray tip configuration of claim 10, wherein the second cylinder comprises a fourth portion diameter that is greater than the sixth portion diameter.

12. The airless spray tip configuration of claim 6, wherein a fourth portion diameter is substantially the same as a fifth portion inlet diameter.

13. A pre-orifice chamber for an airless paint spray tip, the pre-orifice chamber comprising:

an inlet configured to receive a flow of paint;

an outlet configured to spray the flow of paint; and a fluidic passageway coupling the inlet and outlet, wherein the fluidic passageway comprises a plurality of geometric portions comprising at least:

a first cylinder located downstream from the inlet;

a first truncated cone located downstream of the first cylinder, the first truncated cone increasing in diameter from a first hydraulic diameter to a second hydraulic diameter;

a second cylinder located downstream from the first truncated cone;

a second truncated cone located wholly downstream of the first truncated cone and the second cylinder, the second truncated cone decreasing in diameter from a third hydraulic diameter to a fourth hydraulic diameter, wherein the third hydraulic diameter is larger than the second hydraulic diameter; and a third cylinder located downstream from the second truncated cone.

14. The pre-orifice chamber of claim 13, and further comprising a partial spheroid, wherein the partial spheroid comprises the outlet.

15. The pre-orifice chamber of claim 13, wherein the first truncated cone comprises an expansion chamber, and wherein the second truncated cone comprises a contraction chamber.

16. An airless spray tip for a hand-held paint spray gun, the spray tip comprising:

an inlet configured to receive a pressurized flow of paint;

an outlet configured to spray the pressurized flow of paint; and a fluid pathway fluidically coupling the inlet and the outlet such that the pressurized flow of paint flows downstream from the inlet to the outlet, and wherein the fluid pathway comprises at least:

a first chamber comprising a cylinder;

a second chamber, downstream from the first chamber, comprising a truncated cone that narrows in a downstream direction;

a third chamber, downstream from the second chamber, wherein the third chamber has a third chamber inlet diameter greater than an outlet diameter of the second chamber such that a surface generally perpendicular to the fluid pathway is formed between the second chamber and the third chamber;

a fourth chamber, downstream from the third chamber, the fourth chamber comprising a contracting cross-sectional area; and a fifth chamber, downstream from the fourth chamber, comprising an outlet.

17. The airless spray tip of claim 16, wherein the fourth chamber comprises a second truncated cone.

18. The airless spray tip of claim 16, and further comprising a sixth chamber, located downstream from the fourth chamber and upstream from the fifth chamber.

19. The airless spray tip of claim 18, wherein the sixth chamber comprises a sixth chamber inlet diameter that is smaller than a fourth chamber outlet diameter.

20. The airless spray tip of claim 16, wherein the first chamber comprises a first diameter, and wherein the first diameter is substantially similar to an inlet diameter of the truncated cone.

21. The airless spray tip of claim 20, wherein the first chamber comprises a first diameter, and wherein the first diameter is smaller than the third chamber inlet diameter.

22. The airless spray tap configuration of claim 1, further comprising:

a fifth portion comprising a spheroid having a diameter equal to the fifth hydraulic diameter, wherein the fifth portion is fluidically coupled to, downstream of the fourth portion.

23. The airless spray tip configuration of claim 22, wherein a combined axial length of the second portion, the third portion, the fourth portion and the fifth portion is at least 0.15 inches long.

24. The airless spray tip configuration of claim 23, where in the combined axial length is no greater than 0.17 inches long.

25. The airless spray tip configuration of claim 1, wherein radii corresponding to the first portion, the second portion, the third portion, the fourth portion and the fifth portion have pure cylindrical geometries.

26. The airless spray tip configuration of claim 2, wherein the first portion and the fifth portion are defined by a first component and the second portion, third portion and fourth portion are defined by a second component that is downstream of the first component.

27. The airless spray tip configuration of claim 6, wherein the second hydraulic diameter is greater than double the first hydraulic diameter.

28. The airless spray tip configuration of claim 6, wherein the third hydraulic diameter is greater than double the first hydraulic diameter.

29. The airless spray tip configuration of claim 6, wherein an axial length of the second portion is less than the second hydraulic diameter.

30. The airless spray tip configuration of claim 6, wherein an axial length of the third portion is less than both the second hydraulic diameter and the third hydraulic diameter.

31. The airless spray tip configuration of claim 6, wherein an axial length of the fourth portion is greater than any axial length corresponding to the first portion, the second portion, the third portion or the fifth portion.

32. The airless spray tip configuration of claim 6, wherein a combined axial length of the second portion, the third portion, the fourth portion and the fifth portion is greater than 0.16 inches.

33. The airless spray tip configuration of claim 32, wherein the combined axial length is less than 0.17 inches.

34. The airless spray tip of claim 17, wherein the second truncated cone narrows in the downstream direction.

35. An airless spray tip configuration comprising:

an inlet orifice configured to receive a fluid;

an outlet orifice configured to emit the fluid in a spray pattern;

a passageway fluidically coupling the inlet orifice to the outlet orifice; and wherein the passageway, comprises:

a first portion comprising an expansion chamber with a first axial distance, a first effective radius and a second effective radius, wherein the first effective radius is shorter than the second effective radius, wherein the first portion is configured to receive the fluid to be sprayed from the inlet orifice;

a second portion comprising a first cylinder with a second axial distance and a third effective radius, wherein the second portion is fluidically connects to the first portion at a first interface and wherein the second effective radius is shorter than the third effective radius;

a third portion comprising a contraction chamber initiating at the third effective radius and terminating at a fourth effective radius over a third axial distance, wherein the second portion fluidically connects to the third portion at a second interface; and a fourth portion comprising a second cylinder with a fifth effective radius that is less than the fourth effective radius and a spheroid with a spheroid radius, wherein the third portion fluidically couples to the fourth portion at a third interface, and wherein the fourth portion comprises the outlet orifice.

36. The airless spray tip configuration of claim 35, wherein a combined axial length of the second portion, third portion and the fourth portion is greater than 0.16 inches.

37. The airless spray tip configuration of claim 36, wherein the combined axial length is less than 0.17 inches.

38. An airless spray tip configuration comprising:

an inlet orifice configured to receive a fluid;

an outlet orifice configured to emit the fluid in a spray pattern; and a passageway fluidically coupling the inlet orifice to the outlet orifice, the passageway comprises:

a first portion having a first cylinder;

a second portion coupled to the first portion downstream of the first portion, having a first cone that widens in a downstream direction;

a third potation coupled to the second portion downstream of the second portion, having a second cylinder that is wider than any previous portion of the passageway;

a fourth portion coupled to the third portion downstream of the third portion, having a second cone that narrows in the downstream direction; and a fifth portion coupled to the fourth portion downstream of the fourth portion having a third cylinder that is half as narrow as any section of the third portion and fourth portion.

39. The airless spray tip configuration of claim 38, wherein the second cylinder is at least twice as wide as any previous portion of the passageway.

40. The airless spray tip configuration of claim 38, wherein the second cylinder is at least three times as wide as any previous portion of the passageway.

41. The airless spray tip configuration of claim 38, wherein a substantially perpendicular surface is formed at the coupling between the second portion and third portion.

42. The airless spray tip configuration of claim 38, wherein a substantially perpendicular surface is formed at the coupling between the fourth portion and fifth portion.

43. The airless spray tip configuration of claim 38, wherein the passageway further comprises a sixth portion coupled to the fifth portion downstream of the fifth portion, having a spheroid with a radius substantially equal to a width of the fifth portion.

44. The airless spray tip configuration of claim 38, wherein a combined axial length of the third portion, the fourth portion and the fifth portion is greater than 0.16 inches.

45. The airless spray tip configuration of claim 38, wherein a combined axial length of the third portion, the fourth portion and the fifth portion is less than 0.17 inches.

46. The airless spray tip configuration of claim 38, wherein the first portion and the second portion are formed in a first pre-orifice insert and the third portion, the fourth portion and the filth portion are formed in a second pre-orifice insert.

47. The airless spray tip configuration of claim 46, wherein the first pre-orifice insert and the second pre-orifice insert are press fit into a channel of a cylindrical lip body.

48. The airless spray tip configuration of claim 47, wherein the cylindrical tip body comprises a pre-orifice space, formed in the cylindrical tip body, that is fluidically coupled to the first portion, upstream of the first portion.

49. The airless spray tip configuration of claim 48, wherein the pre-orifice space comprises a tip body hydraulic diameter that is larger than a first portion hydraulic diameter of the first portion.

50. The airless spray tip configuration of claim 49, wherein a substantially perpendicular surface is formed at the coupling between the pre-orifice space and the first portion.

* * * * *